US005928765A

United States Patent [19]

Malhotra

[11] Patent Number: 5,928,765

[45] Date of Patent: Jul. 27, 1999

[54] RECORDING SHEETS

[75] Inventor: Shadi L. Malhotra, Mississauga, Canada

[73] Assignee: Xerox Corporation, Stamford, Conn.

[21] Appl. No.: 08/418,040

[22] Filed: Apr. 6, 1995

Related U.S. Application Data

[60] Division of application No. 08/196,673, Feb. 15, 1994, Pat. No. 5,451,458, which is a continuation-in-part of application No. 08/033,932, Mar. 19, 1993, Pat. No. 5,302,439.

[51] Int. Cl.[6] ..... B41M 5/00

[52] U.S. Cl. ..... 428/195; 428/412; 428/480; 428/500; 428/520; 430/126

[58] Field of Search ..... 430/126; 428/195, 428/211, 537.5, 412, 480, 500, 520

[56] References Cited

U.S. PATENT DOCUMENTS

| | | | |
|---|---|---|---|
| 3,488,189 | 1/1970 | Mayer et al. | 96/1.5 |
| 3,493,412 | 2/1970 | Johnston et al. | 117/17.5 |
| 3,561,337 | 2/1971 | Mulkey | 95/1 |
| 3,619,279 | 11/1971 | Johnston et al. | 117/155 |
| 3,876,463 | 4/1975 | Cree | 430/126 |
| 3,879,196 | 4/1975 | Nagashima et al. | 430/126 |
| 3,880,656 | 4/1975 | Nagashima et al. | 430/126 |
| 4,260,671 | 4/1981 | Merrill | 430/96 |
| 4,269,921 | 5/1981 | Kanaka et al. | 430/119 |
| 4,510,225 | 4/1985 | Kuehnle et al. | 430/126 |
| 4,526,847 | 7/1985 | Walker et al. | 430/18 |
| 4,599,293 | 7/1986 | Eckell et al. | 430/126 |
| 4,650,808 | 3/1987 | May et al. | 514/372 |
| 4,956,225 | 9/1990 | Malhotra | 428/216 |
| 4,968,572 | 11/1990 | Kato et al. | 430/96 |
| 4,997,697 | 3/1991 | Malhotra | 428/195 |
| 5,093,168 | 3/1992 | Suzuki et al. | 428/40 |
| 5,118,570 | 6/1992 | Malhotra | 428/474.4 |
| 5,145,749 | 9/1992 | Matthew | 428/511 |
| 5,202,205 | 4/1993 | Malhotra | 430/17 |
| 5,244,714 | 9/1993 | Malhotra et al. | 428/195 |
| 5,317,000 | 5/1994 | Bloodworth et al. | 503/227 |
| 5,330,961 | 7/1994 | Kakeyama et al. | 503/227 |

FOREIGN PATENT DOCUMENTS

| | | | |
|---|---|---|---|
| A-10498083 | 2/1991 | European Pat. Off. | B41M 5/00 |
| A-10523511 | 7/1992 | European Pat. Off. | B41M 5/00 |
| A-1543339 | 11/1992 | European Pat. Off. | B41M 5/00 |
| 4030622 | 9/1990 | Germany | G03G 5/022 |
| A-2085806 | 10/1981 | United Kingdom | G03G 19/00 |

*Primary Examiner*—Bruce H. Hess
*Attorney, Agent, or Firm*—Judith L. Byorick

[57] ABSTRACT

Disclosed is a recording sheet which comprises (a) a substrate; (b) a coating on the substrate which comprises (1) a binder selected from the group consisting of (A) polyesters; (B) polyvinyl acetals; (C) vinyl alcohol-vinyl acetal copolymers; (D) polycarbonates; and (E) mixtures thereof; and (2) an additive having a melting point of less than about 65° C. and a boiling point of more than about 150° C. and selected from the group consisting of (1) furan derivatives; (2) cyclic ketones; (3) lactones; (4) cyclic alcohols; (5) cyclic anhydrides; (6) acid esters; (7) phosphine oxides; and (8) mixtures thereof; (c) an optional filler; (d) an optional antistatic agent; and (e) an optional biocide. Also disclosed is a process for generating images which comprises (1) generating an electrostatic latent image on an imaging member in an imaging apparatus; (2) developing the latent image with a toner which comprises a colorant and a resin selected from the group consisting of (A) polyesters; (B) polyvinyl acetals; (C) vinyl alcohol-vinyl acetal copolymers; (D) polycarbonates; and (E) mixtures thereof; and (3) transferring the developed image to a recording sheet which comprises (a) a substrate; (b) a coating on the substrate which comprises (1) a binder selected from the group consisting of (A) polyesters; (B) polyvinyl acetals; (C) vinyl alcohol-vinyl acetal copolymers; (D) polycarbonates; and (E) mixtures thereof; and (2) an additive having a melting point of less than about 65° C. and a boiling point of more than about 150° C. and selected from the group consisting of (1) furan derivatives; (2) cyclic ketones; (3) lactones; (4) cyclic alcohols; (5) cyclic anhydrides; (6) acid esters; (7) esters; (8) phenones; (9) phosphine oxides; and (10) mixtures thereof; (c) an optional filler; (d) an optional antistatic agent; and (e) an optional biocide.

29 Claims, No Drawings

RECORDING SHEETS

This is a division of application Ser. No. 08/196,673, filed Feb. 15, 1994, now U.S. Pat. No. 5,451,458, which is a continuation-in-part of application U.S. Ser. No. 08/033,932, filed Mar. 19, 1993, now U.S. Pat. No. 5,302,439, entitled "Recording Sheets", the disclosure of which is totally incorporated herein by reference.

BACKGROUND OF THE INVENTION

The present invention is directed to coated recording sheets. More specifically, the present invention is directed to recording sheets particularly suitable for use in electrophotographic printing processes. One embodiment of the present invention is directed to a recording sheet which comprises (a) a substrate; (b) a coating on the substrate which comprises (1) a binder selected from the group consisting of (A) polyesters; (B) polyvinyl acetals; (C) vinyl alcohol-vinyl acetal copolymers; (D) polycarbonates; and (E) mixtures thereof; and (2) an additive having a melting point of less than about 65° C. and a boiling point of more than about 150° C. and selected from the group consisting of (1) furan compounds; (2) cyclic ketones; (3) lactones; (4) cyclic alcohols; (5) cyclic anhydrides; (6) acid esters; (7) phosphine oxides; and (8) mixtures thereof; (c) an optional filler; (d) an optional antistatic agent; and (e) an optional biocide. Another embodiment of the present invention is directed to a process for generating images which comprises (1) generating an electrostatic latent image on an imaging member in an imaging apparatus; (2) developing the latent image with a toner which comprises a colorant and a resin selected from the group consisting of (A) polyesters; (B) polyvinyl acetals; (C) vinyl alcohol-vinyl acetal copolymers; (D) polycarbonates; and (E) mixtures thereof; and (3) transferring the developed image to a recording sheet which comprises (a) a substrate; (b) a coating on the substrate which comprises (1) a binder selected from the group consisting of (A) polyesters; (B) polyvinyl acetals; (C) vinyl alcohol-vinyl acetal copolymers; (D) polycarbonates; and (E) mixtures thereof; and (2) an additive having a melting point of less than about 65° C. and a boiling point of more than about 150° C. and selected from the group consisting of (1) furan compounds; (2) cyclic ketones; (3) lactones; (4) cyclic alcohols; (5) cyclic anhydrides; (6) acid esters; (7) esters; (8) phenones; (9) phosphine oxides; and (10) mixtures thereof; (c) an optional filler; (d) an optional antistatic agent; and (e) an optional biocide.

U.S. Pat. No. 5,118,570 (Malhotra) and U.S. Pat. No. 5,006,407 (Malhotra), the disclosures of each of which are totally incorporated herein by reference, disclose a transparency which comprises a hydrophilic coating and a plasticizer, which plasticizer can, for example, be from the group consisting of phosphates, substituted phthalic anhydrides, glycerols, glycols, substituted glycerols, pyrrolidinones, alkylene carbonates, sulfolanes, and stearic acid derivatives.

U.S. Pat. No. 5,145,749 (Matthew) discloses erasable coatings for xerography paper which comprise a pigment such as calcium carbonate in a binder such as an aqueous emulsion of an acrylic polymer. The erasability of the coating is improved by replacing at least 15 weight percent of the binder with a polyalkane or polyalkene wax, such as an aqueous emulsion of a polyolefin.

U.S. Pat. No. 4,526,847 (Walker et al.) discloses a transparency for the formation of an adherent electrostatic image thereon which includes a polyester resin film sheet having an image-receiving coating of nitrocellulose, a plasticizer, a particulate material, and, preferably, an antistatic agent. The coating is applied to the film sheet from a solvent mixture of an aliphatic ester or an aliphatic ketone, and an aliphatic alcohol.

U.S. Pat. No. 3,619,279 (Johnston et al.) discloses a toner receiving member having available at an external surface a solid crystalline plasticizer to reduce the fusion power requirements when toner is fused to the receiving member. The external surface of the toner receiving member is substantially free of material plasticizable by the solid crystalline plasticizer. Typically a plasticizer such as ethylene glycol dibenzoate may be available on the surface of paper.

U.S. Pat. No. 3,561,337 (Mulkey) discloses a sheet material having a transparent backing coated with a layer containing a polymeric binder and particles of solid material which is insoluble in the binder. The refractive index of the solid material varies from that of the binder by at most ±0.6. The surface of the layer is ink receptive and, by printing on that surface, a transparency is obtained.

U.S. Pat. No. 3,493,412 (Johnston et al.) discloses an imaging process wherein an electrostatic latent image is developed with a thermoplastic resin toner on an imaging surface and the toner image is transferred to an image receiving surface carrying an amount of a solid crystalline plasticizer sufficient to lower the toner fusion requirements when the toner image is fused to the receiving surface.

U.S. Pat. No. 3,488,189 (Mayer et al.) discloses the formation of fused toner images on an imaging surface corresponding to an electrostatic field by depositing on the imaging surface in image configuration toner particles containing a thermoplastic resin, the imaging surface carrying a solid crystalline plasticizer having a lower melting point than the melting range of the thermoplastic resin and heat fusing the resulting toner image.

U.S. Pat. No. 4,956,225 (Malhotra) discloses a transparency suitable for electrographic and xerographic imaging which comprises a polymeric substrate with a toner receptive coating on one surface thereof comprising blends selected from the group consisting of: poly(ethylene oxide) and carboxymethyl cellulose; poly(ethylene oxide), carboxymethyl cellulose, and hydroxypropyl cellulose; poly (ethylene oxide) and vinylidene fluoride/hexafluoropropylene copolymer; poly(chloroprene) and poly(alpha-methylstyrene); poly(caprolactone) and poly (alpha-methylstyrene). poly(vinyl isobutyl ether) and poly (alpha-methylstyrene); poly(caprolactone) and poly(p-isopropyl alpha-methylstyrene); blends of poly(1,4-butylene adipate) and poly(alpha-methylstyrene); chlorinated poly (propylene) and poly(alpha-methylstyrene); chlorinated poly(ethylene) and poly(alpha-methylstyrene); and chlorinated rubber and poly(alpha-methylstyrene). Also disclosed are transparencies with first and second coating layers.

U.S. Pat. No. 4,997,697 (Malhotra) discloses a transparent substrate material for receiving or containing an image which comprises a supporting substrate base, an antistatic polymer layer coated on one or both sides of the substrate and comprising hydrophilic cellulosic components, and a toner receiving polymer layer contained on one or both sides of the antistatic layer, which polymer comprises hydrophobic cellulose ethers, hydrophobic cellulose esters, or mixtures thereof, and wherein the toner receiving layer contains adhesive components.

U.S. Pat. No. 5,202,205 (Malhotra), the disclosure of which is totally incorporated herein by reference, discloses a transparent substrate material for receiving or containing an image comprising a supporting substrate, an ink toner receiving coating composition on both sides of the substrate and comprising an adhesive layer and an antistatic layer contained on two surfaces of the adhesive layer, which antistatic layer comprises mixtures or complexes of metal halides or urea compounds both with polymers containing oxyalkylene segments.

U.S. Pat. No. 5,244,714 (Malhotra et al.), the disclosure of which is totally incorporated herein by reference, discloses a recording sheet which comprises a base sheet, an antistatic layer coated on at least one surface of the base sheet comprising a mixture of a first component selected from the group consisting of hydrophilic polysaccharides and a second component selected from the group consisting of poly (vinyl amines), poly (vinyl phosphates), poly (vinyl alcohols), poly (vinyl alcohol)-ethoxylated, poly (ethylene imine)-ethoxylated, poly (ethylene oxides), poly (n-vinyl acetamide-vinyl sulfonate salts), melamine-formaldehyde resins, urea-formaldehyde resins, styrene-vinylpyrrolidone copolymers, and mixtures thereof, and at least one toner receiving layer coated on an antistatic layer comprising a material selected from the group consisting of maleic anhydride containing polymers, maleic ester containing polymers, and mixtures thereof.

Copending application U.S. Ser. No. 08/033,932, filed Mar. 19, 1993, entitled "Recording Sheets," with the named inventors Shadi L. Malhotra and Brent S. Bryant, the disclosure of which is totally incorporated herein by reference, discloses a recording sheet which comprises (a) a substrate; (b) a coating on the substrate which comprises a binder and a material having a melting point of less than about 65° C. and a boiling point of greater than 150° C. and selected from the group consisting of alkyl phenones, alkyl ketones, halogenated alkanes, alkyl amines, alkyl anilines, alkyl diamines, alkyl alcohols, alkyl diols, halogenated alkyl alcohols, alkane alkyl esters, saturated fatty acids, unsaturated fatty acids, alkyl aldehydes, alkyl anhydrides, alkanes, and mixtures thereof; (c) an optional traction agent; and (d) an optional antistatic agent.

Copending application U.S. Serial No. (not yet assigned; filed concurrently herewith; Attorney Docket No. D/93598), entitled "Recording Sheets," with the named inventor Shadi L. Malhotra, the disclosure of which is totally incorporated herein by reference, discloses a recording sheet which comprises a substrate and a material selected from the group consisting of monomeric amine acid salts, monomeric quaternary choline halides, and mixtures thereof.

Copending application U.S. Serial No. (not yet assigned; filed concurrently herewith; Attorney Docket No. D/93596), entitled "Recording Sheets," with the named inventor Shadi L. Malhotra, the disclosure of which is totally incorporated herein by reference, discloses a recording sheet which comprises (a) a substrate; (b) a coating on the substrate which comprises (i) a binder selected from the group consisting of (A) copolymers of styrene and at least one other monomer; (B) copolymers of acrylic monomers and at least one other monomer; and (C) mixtures thereof; and (ii) an additive having a melting point of less than about 65° C. and a boiling point of more than about 150° C. and selected from the group consisting of (A) diphenyl compounds; (B) phenyl alkanes; (C) indan compounds; (D) benzene derivatives; (E) benzyl alcohols; (F) phenyl alcohols; (G) menthol; (H) aromatic amines; and (I) mixtures thereof; (c) an optional filler; (d) an optional antistatic agent; and (e) an optional biocide. Also disclosed is a process for generating images which comprises (1) generating an electrostatic latent image on an imaging member in an imaging apparatus; (2) developing the latent image with a toner which comprises a colorant and a resin selected from the group consisting of (A) copolymers of styrene and at least one other monomer; (B) copolymers containing acrylic monomers and at least one other monomer; and (C) mixtures thereof; and (3) transferring the developed image to a recording sheet which comprises (a) a substrate; (b) a coating on the substrate which comprises (i) a polymeric binder selected from the group consisting of (A) copolymers of styrene and at least one other monomer; (B) copolymers of acrylic monomers and at least one other monomer; and (C) mixtures thereof; and (ii) an additive having a melting point of less than about 65° C. and a boiling point of more than about 150° C. and selected from the group consisting of (A) diphenyl compounds; (B) phenyl alkanes; (C) indan compounds; (D) benzene derivatives; (E) benzyl alcohols; (F) phenyl alcohols; (G) menthol; (H) aromatic amines; (I) aliphatic amines; (J) aldehydes; (K) aldehyde derivatives; and (L) mixtures thereof; (c) an optional filler; (d) an optional antistatic agent; and (e) an optional biocide.

While the above materials and processes are suitable for their intended purposes, a need remains for recording sheets particularly suitable for use in electrophotographic applications. In addition, a need remains for recording sheets which can be employed with xerographic toners so that the heat and energy required for fusing the toner to the recording sheet is reduced. Further, a need remains for recording sheets which can be employed with xerographic toners so that jamming of the recording sheet in the fusing apparatus is reduced. Additionally, there is a need for recording sheets suitable for use in electrophotographic applications with reduced fusing energy requirements and reduced jamming, wherein the sheets also exhibit acceptable image quality and image fix to the recording sheet.

SUMMARY OF THE INVENTION

It is an object of the present invention to provide a recording sheet with the above advantages.

It is another object of the present invention to provide recording sheets particularly suitable for use in electrophotographic applications.

It is yet another object of the present invention to provide recording sheets which can be employed with xerographic toners so that the heat and energy required for fusing the toner to the recording sheet is reduced.

It is still another object of the present invention to provide recording sheets which can be employed with xerographic toners so that jamming of the recording sheet in the fusing apparatus is reduced.

Another object of the present invention is to provide recording sheets suitable for use in electrophotographic applications with reduced fusing energy requirements and reduced jamming, wherein the sheets also exhibit acceptable image quality and image fix to the recording sheet.

These and other objects of the present invention (or specific embodiments thereof) can be achieved by providing a recording sheet which comprises (a) a substrate; (b) a coating on the substrate which comprises (1) a binder selected from the group consisting of (A) polyesters; (B) polyvinyl acetals; (C) vinyl alcohol-vinyl acetal copolymers; (D) polycarbonates; and (E) mixtures thereof; and (2) an additive having a melting point of less than about 65° C. and a boiling point of more than about 150° C. and selected from the group consisting of (1) furan compounds; (2) cyclic ketones; (3) lactones; (4) cyclic alcohols; (5) cyclic anhydrides; (6) acid esters; (7) phosphine oxides; and (8) mixtures thereof; (c) an optional filler; (d) an optional antistatic agent; and (e) an optional biocide. Another embodiment of the present invention is directed to a process for generating images which comprises (1) generating an electrostatic latent image on an imaging member in an imaging apparatus; (2) developing the latent image with a toner which comprises a colorant and a resin selected from the group consisting of (A) polyesters; (B) polyvinyl acetals; (C) vinyl alcohol-vinyl acetal copolymers; (D) polycarbonates; and (E) mixtures thereof; and (3) transferring the developed image to a recording sheet which comprises (a) a substrate; (b) a coating on the substrate which comprises (1) a binder selected from the group consisting of (A) polyesters; (B) polyvinyl acetals; (C) vinyl alcohol-vinyl acetal copolymers; (D) polycarbonates; and (E) mixtures thereof; and (2) an additive having a melting point of less than about 65° C. and a boiling point of more than about 150° C. and selected from the group consisting of (1) furan compounds; (2) cyclic ketones; (3) lactones; (4) cyclic alcohols; (5) cyclic anhydrides; (6) acid esters; (7) esters; (8) phenones; (9) phosphine oxides; and (10) mixtures thereof; (c) an optional filler; (d) an optional antistatic agent; and (e) an optional biocide.

DETAILED DESCRIPTION OF THE INVENTION

The recording sheets of the present invention comprise a substrate or base sheet having a coating on one or both surfaces thereof. Any suitable substrate can be employed. Examples of substantially transparent substrate materials include polyesters, including Mylar™, available from E.I. Du Pont de Nemours & Company, Melinex™, available from Imperial Chemicals, Inc., Celanar™, available from Celanese Corporation, polyethylene naphthalates, such as Kaladex PEN films, available from Imperial Chemical Industries, polycarbonates such as Lexan™, available from General Electric Company, polysulfones, such as those available from Union Carbide Corporation, polyether sulfones, such as those prepared from 4,4'-diphenyl ether, such as Udel™, available from Union Carbide Corporation, those prepared from disulfonyl chloride, such as Victrex™, available from ICI Americas Incorporated, those prepared from biphenylene, such as Astrel™, available from 3M Company, poly (arylene sulfones), such as those prepared from crosslinked poly(arylene ether ketone sulfones), cellulose triacetate, polyvinylchloride cellophane, polyvinyl fluoride, polyimides, and the like, with polyester such as Mylar™ being preferred in view of its availability and relatively low cost. The substrate can also be opaque, including opaque plastics, such as Teslin™, available from PPG Industries, and filled polymers, such as Melinex®, available from ICI. Filled plastics can also be employed as the substrate, particularly when it is desired to make a "never-tear paper" recording sheet. Paper is also suitable, including plain papers such as Xerox® 4024, diazo papers, or the like.

In one embodiment of the present invention, the substrate comprises sized blends of hardwood kraft and softwood kraft fibers containing from about 10 to 90 percent by weight soft wood and from about 10 to about 90 percent by weight hardwood. Examples of hardwood include Seagull W dry bleached hardwood kraft, present in one embodiment in an amount of about 70 percent by weight. Examples of softwood include La Tuque dry bleached softwood kraft, present in one embodiment in an amount of about 30 percent by weight. These substrates can also contain fillers and pigments in any effective amounts, typically from about 1 to about 60 percent by weight, such as clay (available from Georgia Kaolin Company, Astro-fil 90 clay, Engelhard Ansilex clay), titanium dioxide (available from Tioxide Company—Anatase grade AHR), calcium silicate CH-427-97-8, XP-974 (J.M. Huber Corporation), and the like. The sized substrates can also contain sizing chemicals in any effective amount, typically from about 0.25 percent to about 25 percent by weight of pulp, such as acidic sizing, including Mon size (available from Monsanto Company), alkaline sizing such as Hercon-76 (available from Hercules Company), Alum (available from Allied Chemicals as Iron free alum), retention aid (available from Allied Colloids as Percol 292), and the like. The preferred internal sizing degree of papers selected for the present invention, including commercially available papers, varies from about 0.4 to about 5,000 seconds, and papers in the sizing range of from about 0.4 to about 300 seconds are more preferred, primarily to decrease costs. Preferably, the selected substrate is porous, and the porosity value of the selected substrate preferably varies from about 100 to about 1,260 milliliters per minute and preferably from about 50 to about 600 milliliters per minute to enhance the effectiveness of the recording sheet in ink jet processes. Preferred basis weights for the substrate are from about 40 to about 400 grams per square meter, although the basis weight can be outside of this range.

Illustrative examples of commercially available internally and externally (surface) sized substrates suitable for the present invention include Diazo papers, offset papers, such as Great Lakes offset, recycled papers, such as Conservatree, office papers, such as Automimeo, Eddy liquid toner paper and copy papers available from companies such as Nekoosa, Champion, Wiggins Teape, Kymmene, Modo, Domtar, Veitsiluoto and Sanyo, and the like, with Xerox® 4024™ papers and sized calcium silicate-clay filled papers being particularly preferred in view of their availability, reliability, and low print through. Pigmented filled plastics, such as Teslin (available from PPG industries), are also preferred as supporting substrates.

The substrate can be of any effective thickness. Typical thicknesses for the substrate are from about 50 to about 500 microns, and preferably from about 100 to about 125 microns, although the thickness can be outside these ranges.

Coated on one or both surfaces of the base sheet is a coating. This coating can be either coated directly onto the base sheet or coated onto another layer of material coated onto the base sheet previously, such as an antistatic layer, an anticurl layer, or the like. This coating comprises a binder selected from the group consisting of (A) polyesters; (B) polyvinyl acetals; (C) vinyl alcohol-vinyl acetal copolymers; (D) polycarbonates; and (E) mixtures thereof, and an additive selected from the group consisting of (1) furan derivatives; (2) cyclic ketones; (3) lactones; (4) cyclic alcohols; (5) cyclic anhydrides; (6) acid esters; (7) esters; (8) phenones; (9) phosphine oxides; and (10) mixtures thereof.

Examples of suitable binder polymers include polyesters, such as polyester latexes, including as AQ-29D, available from Eastman Chemicals, poly(4,4-dipropoxy-2,2-diphenyl propane fumarate) #324, available from Scientific Polymer Products, poly(ethylene terephthalate) #138 and #418, available from Scientific Polymer Products, poly(ethylene succinate) #150, available from Scientific Polymer Products, poly(1,4-cyclohexane dimethylene succinate) #148, available from Scientific Polymer Products, or the like; polyvinyl acetate polymers, such as #346, #347, and #024, available from Scientific Polymer Products, or the like; vinylalcohol-vinyl acetate copolymers, such as those with a vinyl acetate content of about 91 percent by weight, including #379, available from Scientific Polymer Products, or the like; polycarbonates, such as #035, available from Scientific Polymer products, or the like; and the like, as well as mixtures thereof.

The coating composition also contains a non-polymeric material selected from the group consisting of furan compounds, cyclic ketones, lactones, cyclic alcohols, cyclic anhydrides, acid esters, phosphine oxides, and mixtures thereof.

Furan compounds are materials of the general formula

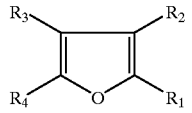

wherein $R_1$, $R_2$, $R_3$, and $R_4$ each, independently of one another, can be (but are not limited to) alkyl (including cyclic alkyl), substituted alkyl, aryl, substituted aryl, arylalkyl, substituted arylalkyl, ester, alkoxy, aldehyde, ketone, hydroxy, or the like. Other variations are also possible, however, such as saturation of one or both of the ring carbon atoms, or a double bond between one or more of the ring carbon atoms and another atom such as carbon, nitrogen, oxygen, sulfur, or the like, or wherein two or more substituents are joined together to form another ring, and the like. Examples of suitable furan derivatives include (A) 2-substituted furans, such as (1) methyl 2-furoate (Aldrich 12,985-2), of the formula:

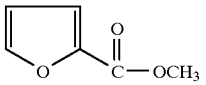

(2) ethyl 2-furoate (Aldrich E2,850-1), of the formula:

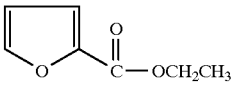

(3) 2-furaldehyde diethylacetal (Aldrich 19,301-1), of the formula:

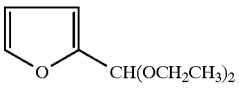

(4) furfuryl acetate (Aldrich 16,620-0), of the formula:

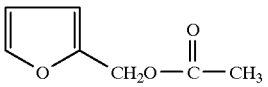

and the like; (B) 2,5-disubstituted furans, such as (1) 2,5-dimethoxy-2,5-dihydrofuran (Aldrich D13,410-4), of the formula:

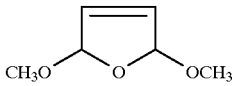

(2) methyl 2,5-dihydro-2,5-dimethoxy-2-furan carboxylate (Aldrich 11,918-0), of the formula:

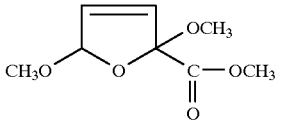

(3) 5-methylfurfural (Aldrich 13,731-6), of the formula:

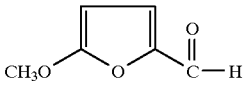

(4) 5-(hydroxymethyl) furfural (Aldrich H4080-7), of the formula:

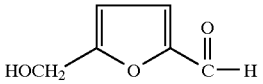

(5) 5-acetoxymethyl-2-furaldehyde (Aldrich 14,542-4), of the formula:

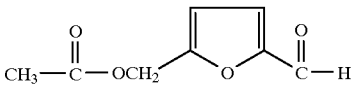

(6) 2-acetyl-5-methyl furan (Aldrich 29,955-3), of the formula:

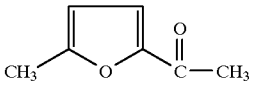

and the like; (C) 3,4-disubstituted furans, such as (1) dimethyl 3,4-furanedicarboxylate (Aldrich 31,749-7), of the formula:

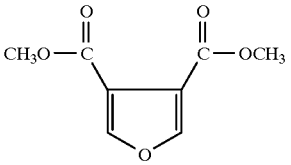

(2) diethyl 3,4-furandicarboxylate (Aldrich 12,903-8), of the formula:

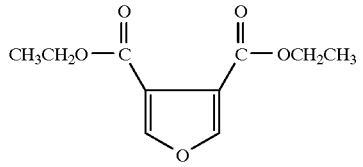

(3) 3,4-bis(acetoxymethyl) furan (Aldrich 14,409-6), of the formula:

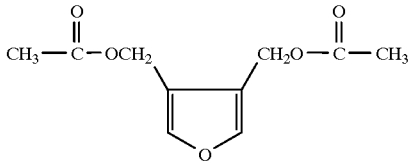

and the like; (D) 3,2,5-trisubstituted furans, such as 3-acetyl-2,5-dimethyl furan (Aldrich 30, 269-4), of the formula:

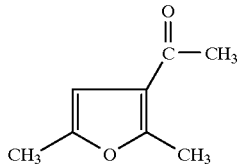

and the like; (E) 3-substituted furans, such as ethyl β-oxo-3-furanpropionate (Aldrich 29,346-6), of the formula:

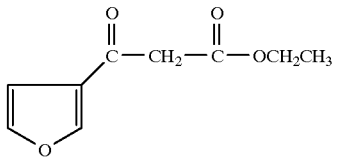

and the like; (F) benzofurans, such as (1) 2,3-dihydrobenzofuran (Aldrich 18,396-2), of the formula:

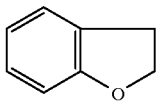

(2) 2-methylbenzofuran (Aldrich 22,434-0), of the formula:

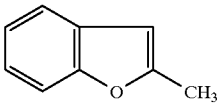

(3) 2-methoxydibenzofuran (Aldrich 26,454-7), of the formula:

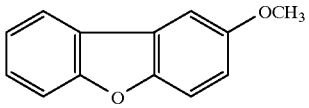

and the like; (G) substituted tetrahydrofurans, such as (1) 3-hydroxy tetrahydrofuran (Aldrich H5,910-9), of the formula:

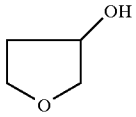

(2) (±)-2-ethyoxy-tetrahydrofuran (Aldrich 20,992-9), of the formula:

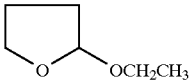

(3) tetrahydrofurfuryl alcohol (Aldrich 18,539-6), of the formula:

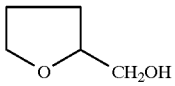

(4) tetrahydrofurfuryl amine (Aldrich 13,191-1), of the formula:

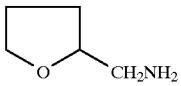

(5) tetrahydrofurfuryl chloride (Aldrich 25,476-2), of the formula:

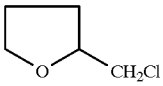

(6) 2,3-diethoxytetrahydrofuran (Aldrich 26,264-1)

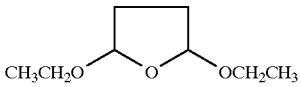

and the like, as well as mixtures thereof.

Cyclic ketones generally are cyclic hydrocarbons (either saturated or unsaturated) wherein at least one of the ring carbon atoms is joined by a double bond to an oxygen atom. Other substituents may also be present on the ring. Examples of suitable cyclic ketones include compounds of the general formula $C_nH_{2(n-1)}(=0)$, wherein n is a number of from about 6 to about 15, as well as substituted compounds of this general formula, such as (1) n=6, cyclohexanone $C_6H_{10}(=0)$ (Aldrich C10,218-0); (2) n=7, cycloheptanone $C_7H_{12}(=0)$ (Aldrich C9,900-0); (3) n=8, cyclooctanone $C_8H_{14}(=0)$ (Aldrich C10,980-0); (4) n=9, cyclononanone $C_9H_{16}(=0)$ (Aldrich C10,900-2); (5) n=10, cyclodecanone $C_{10}H_{18}(=0)$ (Aldrich C9,660-5); (6) n=11, cycloundecanone $C_{11}H_{20}(=0)$ (Aldrich 10,186-9); (7) n=12, cyclododecanone $C_{12}H_{22}(=0)$ (Aldrich C9,745-8); (8) n=13, cyclotridecanone $C_{13}H_{24}(=0)$ (Aldrich 16,063-6); (9) cyclopentadecanone $C_{15}H_{28}(=0)$ (Aldrich C11,120-1); (10) 2-phenylcyclohexanone $C_6H_5C_6H_9(=0)$ (Aldrich P2,227-3); (11) cyclohexane dione $C_6H_8(=0)_2$ (Aldrich C10,110-9); (12) tropolone (Aldrich T8,970-2), of the formula:

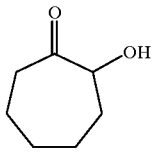

(13) 1,4-cyclohexanedione mono-2,2-dimethyl trimethylene ketal (Aldrich 21,557-0), of the formula:

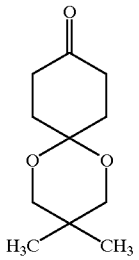

(14) 8-cyclohexadecen-1-one (Aldrich 30,967-2), of the formula:

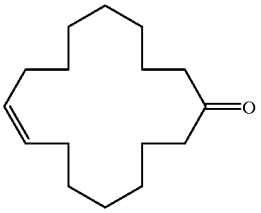

and the like, as well as mixtures thereof.

Lactones generally are cyclic ester compounds wherein a ring structure contains an oxygen atom as part of the ring and, directly adjacent to the oxygen atom, a carbon atom is joined to an oxygen atom by a double bond. The ring may be saturated or unsaturated, and may also have substituents thereon, including situations wherein two or more substituents are joined together to form another ring. Examples of suitable lactones include (1) undecanoic ω-lactone (Aldrich 34,361-7), of the formula:

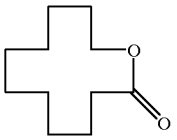

(2) oxacyclotridecan-2-one (Aldrich 34,896-1), of the formula:

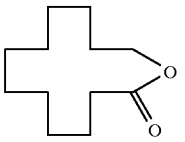

(3) γ-butyrolactone (Aldrich B10,360-8), of the formula:

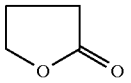

(4) γ-valerolactone (Aldrich V40-3), of the formula:

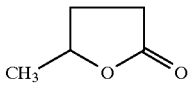

(5) γ-caprolactone (Aldrich 30,383-6), of the formula:

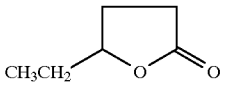

(6) γ-octanoic lactone (Aldrich 0-400-8), of the formula:

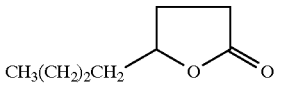

(7) γ-nonanoic lactone (Aldrich 29,237-0), of the formula:

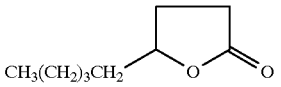

(8) γ-decanolactone (Aldrich D80-4), of the formula:

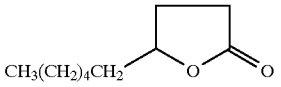

(9) undecanoic γ-lactone (Aldrich U80-6), of the formula:

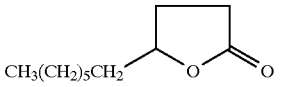

(10) γ-phenyl-γ-butyrolactone (Aldrich 17,645-1), of the formula:

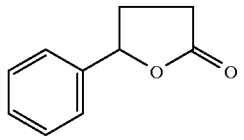

(11) (±)-α-carbethoxy-γ-phenyl-butyrolactone (Aldrich 29,370-9), of the formula:

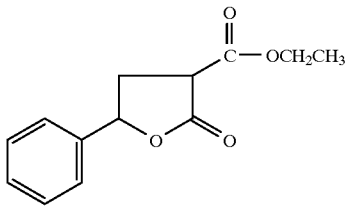

(12) 2-coumaranone (Aldrich 12,459-1), of the formula:

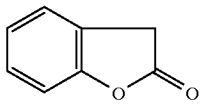

(13) (±)-β,β-dimethyl-γ-(hydroxymethyl)-γ-butyrolactone (Aldrich 26,496-2), of the formula:

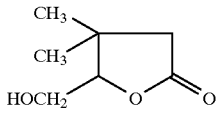

(14) (S)-(+)-γ-ethoxy carbonyl-γ-butyrolactone (Aldrich 31,852-3), of the formula:

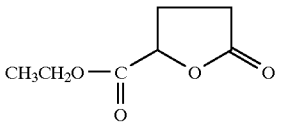

(15) (S)-(−)-5-(hydroxymethyl)-2(5H)-furanone (Aldrich 34,686-1), of the formula:

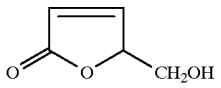

(16) (±)-mevalonic (β-hydroxy-β-methyl-δ-valero) lactone (Aldrich 28,670-2), of the formula:

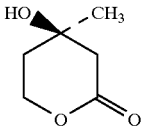

(17) (±)-δ-decanolactone (Aldrich 29,806-9), of the formula:

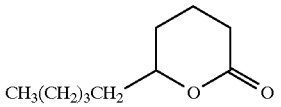

(18) (±)-undecanoic-δ-lactone (Aldrich 29,127-7), of the formula:

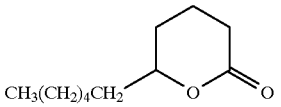

(19) (±)-8-dodecanolactone (Aldrich 29,807-7), of the formula:

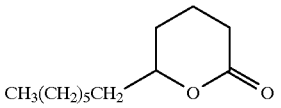

and the like, as well as mixtures thereof.

Cyclic alcohols generally are cyclic hydrocarbon rings (either saturated or unsaturated) wherein at least one of the ring carbon atoms is bonded to a hydroxy group. Examples of cyclic alcohols include (1) D,L-1,2-cycloheptane diol (Aldrich 22,480-4), of the formula:

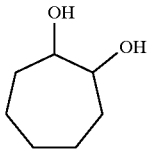

(2) cis-3,5-cyclohexadiene-1,2-diol (Aldrich 30,152-3), of the formula:

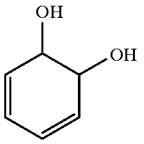

and the like, as well as mixtures thereof.

Cyclic anhydrides generally are compounds wherein a ring structure contains an oxygen atom as part of the ring and both carbons directly adjacent to the oxygen atom are joined to oxygen atoms by double bonds. The ring may be saturated or unsaturated, and may also have substituents thereon, including situations wherein two or more substituents are joined together to form another ring. Examples of suitable cyclic anhydrides include (1) maleic anhydride (Aldrich M18-8), of the formula:

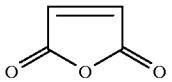

(2) bromo maleic anhydride (Aldrich 10,502-3), of the formula:

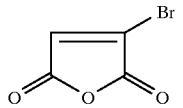

(3) methyl succinic anhydride (Aldrich M8,140-3), of the formula:

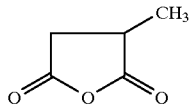

(4) citraconic anhydride (Aldrich 12,531-8), of the formula:

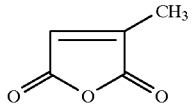

(5) 2,2-dimethyl succinic anhydride (Aldrich 35,769-3), of the formula:

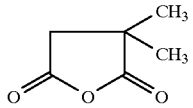

(6) 2-dodecen-1-yl succinic anhydride (Aldrich D22,190-2), of the formula:

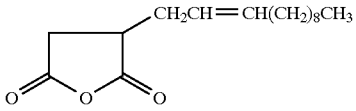

(7) glutaric anhydride (Aldrich G380-6), of the formula:

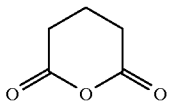

(8) 3-methyl glutaric anhydride (Aldrich M4,780-9), of the formula:

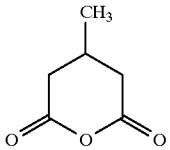

(9) 2,2-dimethyl glutaric anhydride (Aldrich D15,960-3), of the formula:

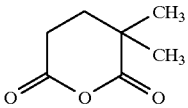

(10) 3,3-tetramethylene glutaric anhydride (Aldrich T2,195-4), of the formula:

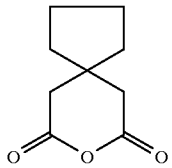

(11) 1-cyclopentene-1,2-dicarboxylic anhydride (Aldrich 31,835-3), of the formula:

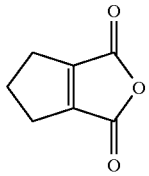

(12) cis-1,2-cyclohexane dicarboxylic anhydride (Aldrich 12,346-3), of the formula:

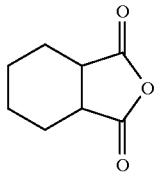

(13) (±)-3-benzyl phthalide (Aldrich 15,320-6), of the formula:

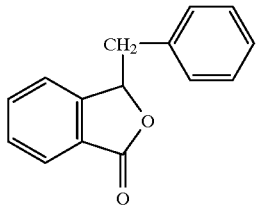

(14) benzoic anhydride (Aldrich 13,865-7) ($[C_6H_5CO]_2O$); (15) (±)-hexahydro-4-methyl phthalic anhydride (Aldrich 14,993-4), of the formula:

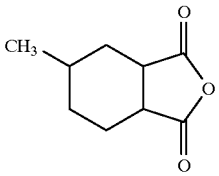

(16) methyl-5-norbornene-2,3-dicarboxylic anhydride (Aldrich 23,543-1), of the formula:

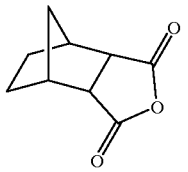

and the like, as well as mixtures thereof.

Acid ester compounds generally are those compounds having both a carboxylic acid functional group and an ester functional group. Examples of suitable acid esters include (1) adipic acid monomethyl ester [$HOOC(CH_2)_4COOCH_3$] (AldrichA2, 640-3); (2) adipic acid monoethyl ester [$HOOC(CH_2)_4COOC_2H_5$] (Aldrich 12,276-9); (3) suberic acid monomethyl ester [$HOOC(CH_2)_6COOCH_3$] (Aldrich 24,244-6); (4) azelaic acid monomethyl ester [$HOOC(CH_2)_7COOCH_3$] (Aldrich A9,620-7); and the like, as well as mixtures thereof.

Examples of suitable esters include dialkyl aliphatic esters, such as wherein alkyl is methyl, including (1) dimethyl oxalate [$CH_3OOCCOOCH_3$] (Aldrich 13,562-3); (2) dimethyl malonate [$CH_3OOCCH_2COOCH_3$] (Aldrich 13,644-1); (3) dimethyl succinate [$CH_3OOC(CH_2)_2COOCH_3$] (Aldrich 11,275-5); (4) dimethyl glutarate [$CH_3OOC(CH_2)_3COOCH_3$] (Aldrich D15,880-1); (5) dimethyl adipate [$CH_3OOC(CH_2)_4COOCH_3$] (Aldrich 33,210-0); (6) dimethyl pimelate [$CH_3OOC(CH_2)_5(CH_2)_5COOCH_3$] (Aldrich 18,006-8); (7) dimethyl suberate [$CH_3OOC(CH_2)_6COOCH_3$] (Aldrich 14,901-2); (8) dimethyl azelate [$CH_3OOC(CH_2)_7COOCH_3$] (Aldrich 17,102-6); (9) dimethyl sebacate [$CH_3OOC(CH_2)_8COOCH_3$] (Aldrich 22,311-5); (10) dimethyl brassylate [$CH_3OOC(CH_2)_{11}COOCH_3$] (Aldrich 17,190-5); (11) dimethyl tartrate [$(CH(OH)COOCH_3]_2$ (Aldrich 24,294-2); (12) dimethyl methyl malonate [$CH_3CH(COOCH_3)_2$] (Aldrich 34,028-6); (13) dimethyl methoxy malonate [$CH_3OCH(COOCH_3)_2$] (Aldrich 24,785-5); (14) dimethyl methyl succinate [$CH_3OOCCH_2CH(CH_3)_2COOCH_3$] (Aldrich 17,879-9); (15) dimethyl itaconate [$CH_3OOCCH_2C(=CH_2)COOCH_3$] (Aldrich 10,953-3); (16) dimethyl maleate [$CH_3OOCCH=CHCOOCH_3$] (Aldrich 23,819-8); and the like; wherein alkyl is ethyl, including (1) diethyloxalate [$C_2H_5OOCCOOC_2H_5$] (Aldrich 13,536-4); (2) diethylmalonate [$C_2H_5OOC(CH_2)COOC_2H_5$] (Aldrich D9,775-4); (3) diethyl succinate [$C_2H_5OOC(CH_2)_2COOC_2H_5$] (Aldrich 11,240-2); (4) diethyl glutarate [$C_2H_5OOC(CH_2)_3COOC_2H_5$] (Aldrich D9,600-6); (5) diethyl adipate [$C_2H_5OOC(CH_2)_4COOC_2H_5$] (Aldrich 24,572-0); (6) diethyl pimelate [$C_2H_5OOC(CH_2)_5COOC_2H_5$] (Aldrich D9,970-6); (7) diethyl suberate [$C_2H_5OOC(CH_2)_6COOC_2H_5$] (Aldrich D10,060-9); (8) diethyl azelate [$C_2H_5OOC(CH_2)_7COOC_2H_5$] (Aldrich 12,458-3); (9) diethyl sebacate [$C_2H_5OOC(CH_2)_8COOC_2H_5$] (Aldrich 24,607-7); (10) diethyl dodecanedioate [$C_2H_5OOC(CH_2)_{10}COOC_2H_5$] (Aldrich 13,753-7); (11) diethyl tetradecanedioate [$C_2H_5OOC(CH_2)_{12}COOC_2H_5$] (Aldrich 14,404-5); (12) diethyl methyl malonate [$C_2H_5OOCCH(CH_3)COOC_2H_5$] (Aldrich 12,613-6); (13) diethyl propyl malonate [$C_2H_5OOCCH(CH_2CH_2CH_3)COOC_2H_5$] (Aldrich 22,881-8); (14) diethyl butyl malonate [$C_2H_5OOCCH(CH_3(CH_2)_3)COOC_2H_5$] (Aldrich 11,203-8); (15) diethyl benzyl malonate [$C_2H_5OOCCH(CH_2C_6H_5)COOC_2H_5$] (Aldrich 13,554-2); (16) diethyl phenyl malonate [$C_2H_5OOCCH(C_6H_5)COOC_2H_5$] (Aldrich 11,199-6); (17) diethyl keto malonate [$C_2H_5OOCOCOOC_2H_5$] (Aldrich D9,740-1); (18) diethyl maleate [$C_2H_5OOCCH=CHCOOC_2H_5$] (Aldrich 9,770-3); (19) diethyl fumarate [$C_2H_5OOCCH=CHCOOC_2H_5$] (Aldrich 9,565-4); (20) diethyl glutaconate [$C_2H_5OOCCH=CHCH_2COOC_2H_5$] (Aldrich D9,580-8); (21) diethyl tartrate [—CH(OH)$COOC_2H_5]_2$ (Aldrich 15,684-1); (22) diethyl dimethyl malonate [$(C_2H_5)_2C(COOCH_3)_2$] (Aldrich 14,390-1); (23) diethyl dimethyl malonate [$(C_2H_5)_2C(COOC_2H_5)_2$] (Aldrich 15,681-7); (24) diethyl (bishydroxymethyl) malonate [$(HOCH_2)_2C(COOC_2H_5)$] (Aldrich 19,835-8); other aliphatic esters, such as Miranol Ester PO-LM4, available from Miranol, Incorporated, an oligomeric ester of the formula

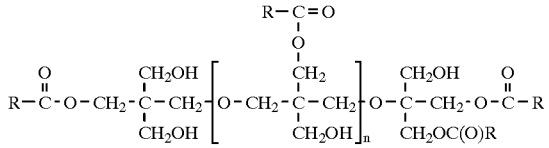

wherein the acyl groups are derived from a blend of lauric and myristic acids and n is an integer of from 1 to about 10, and typically is 1; and the like; as well as aromatic esters, such as (1) methyl salicylate (2-(OH)$C_6H_4COOCH_3$) (Aldrich M8050-4); (2) phenyl salicylate (2-(OH)$C_6H_4COOC_6H_5$) (Aldrich 14,918-7); (3) benzyl cinnamate ($C_6H_5CH=CHCOOCH_2C_6H_5$) (Aldrich 23,421-4); (4) trans methyl cinnamate ($C_6H_5CH=CHCOOCH_3$) (Aldrich 17,328-2); and the like, as well as mixtures thereof.

Phenones are compounds of the general formula

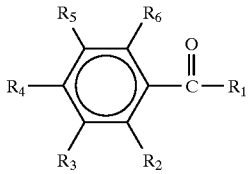

wherein $R_1$ is alkyl (including cyclic alkyl), substituted alkyl, aryl, substituted aryl, arylalkyl, or substituted arylalkyl, and $R_2$, $R_3$, $R_4$, $R_5$, and $R_6$ each, independently of one another, can be (but are not limited to) hydrogen, alkyl (including cyclic alkyl), substituted alkyl, aryl, substituted aryl, arylalkyl, substituted arylalkyl, hydroxy, halogen, alkoxy, aryloxy, arylalkyloxy, cyano, or the like. Examples of suitable phenones include (1) acetophenone $C_6H_5COCH_3$ (Aldrich A1,070-1); (2) 2-chloroacetophenone $C_6H_5COCH_2Cl$ (Aldrich C1,968-6); (3) 2-bromoacetophenone $C_6H_5COCH_2Br$ (Aldrich 11,583-5); (4) 2'-bromoacetophenone ($BrC_6H_4COCH_3$) (Aldrich 18,369-5); (5) 3'-bromoacetophenone (Aldrich B5,635-8)(6) 4'-bromoacetophenone (Aldrich B5,640-6); (7) 2'-choloroacetophenone ($ClC_6H_4COCH_3$) (Aldrich 18,370-9); (8) 3'-chloroacetophenone (Aldrich 28,879-9); (9) 4'-chloroacetophenone (Aldrich C1,970-8); (10) 2-methoxyacetophenone $C_6H_5COCH_2OCH_3$ (Aldrich M960-2); (11) 2'-methoxyacetophenone ($CH_3OC_6H_4COCH_3$) (Aldrich M920-3); (12) 3'-methoxyacetophenone (Aldrich M940-8); (13) 4'-methoxyacetophenone (Aldrich 11,737-4); (14) 4'-ethoxyacetophenone ($C_2H_5OC_6H_4COCH_3$) (Aldrich 27,571-9); (15) 4'-cyanoacetophenone ($CNC_6H_4COCH_3$) (Aldrich 15,439-3); (16) 2',4'-dimethoxyacetophenone $(CH_3O)_2C_6H_3COCH_3$ (Aldrich D12,940-2); (17) 3',4'-dimethoxyacetophenone (Aldrich 15,663-9); (18) 3',5'- dimethoxyacetophenone (Aldrich 16,172-1); (19) 2',4',6'-trimethylacetophenone $(CH_3)_3C_6H_2COCH_3$ (Aldrich T7,240-0); (20) 2'-hydroxy-5-methylacetophenone $(OHC_6H_3(CH_3)COCH_3$ (Aldrich H3,760-1); (21) 2'-hydroxy-4'-methoxyacetophenone (Aldrich H3,580-3); (22) 2'-hydroxy-5'-methoxyacetophenone (Aldrich 11,499-5); (23) 2'-hydroxy-6'-methoxyacetophenone (Aldrich 30,304-6); (24) 2',3',4'-trimethoxyacetophenone $(CH_3O)_3C_6H_2COCH_3$ (Aldrich 18,981-2); (25) 4'-cyclohexylacetophenone $(C_6H_{11}C_6H_4COCH_3)$ (Aldrich 30,116-7); (26) 4'-phenoxyacetophenone $(C_6H_5OC_6H_4COCH_3)$ (Aldrich 29,074-2); (27) 2-bromo-2'-methoxyacetophenone $(CH_3OC_6H_4COCH_2Br)$ (Aldrich 10,085-4); (28) 2-bromo-3'-methoxyacetophenone (Aldrich 11,567-3); (29) 2-bromo-4'-methoxyacetophenone (Aldrich 11,566-5); (30) 2',3',4'-trichloroacetophenone $(Cl_3C_6H_2COCH_3)$ (Aldrich 17,838-1); (31) 2,2',4'-trichloracetophenone $(Cl_2C_6H_3COCH_2Cl)$ (Aldrich 15,925-5); (32) 2',4'-dimethoxy-3'-methylacetophenone (Aldrich 29,881-6); (33) benzophenone $(C_6H_5)_2CO$ (Aldrich B,930-0); (34) 2-hydroxybenzophenone $(HOC_6H_4COC_6H_5)$ (Aldrich 10,316-0); (35) 4-methoxybenzophenone $(CH_3OC_6H_4COC_6H_5)$ (Aldrich M1,030-1); (36) 2-chlorobenzophenone $(ClC_6H_4COC_6H_5)$ (Aldrich 19,438-7); (37) 2,5-dimethylbenzophenone $(CH_3)_2C_6H_3COC_6H_5$ (Aldrich D14,966-7); (38) 3,4-dimethylbenzophenone (Aldrich D14,967-5); (39) butyrophenone $(C_6H_5COCH_2CH_2CH_3)$ (Aldrich 12,433-8); (40) 4'-hydroxyvalerophenone $HOC_6H_4CO(CH_2)_3CH_3$ (Aldrich 24,514-3); (41) isobutyrophenone $C_6H_5COCH(CH_3)_2$ (Aldrich 13,036-2); and the like, as well as mixtures thereof.

Phosphine oxide compounds are of the general formula

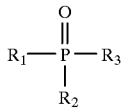

wherein R1, R2, and R3 each, independently of one another, can be (but are not limited to) alkyl (including cyclic alkyl), substituted alkyl, alkoxy, aryl, substituted aryl, aryloxy, arylalkyl, substituted arylalkyl, arylalkyloxy, amino, heterocyclic moieties, and the like. Examples of suitable phosphine oxide compounds include (1) tripiperidinophosphine oxide $(C_5H_{10}N)_3P(O)$ (Aldrich 21,625-9); (2) triphenyl phosphine oxide $(C_6H_5)_3P(O)$ (Aldrich T8,460-3); (3) tris (hydroxymethyl) phosphine oxide $(CH_2OH)_3P(O)$ (Aldrich 17,790-3); (4) trimethoxy phosphine oxide $(CH_3O)_3P(O)$ (Aldrich 13,219-5); (5) triphenoxy phosphine oxide $(C_6H_5O)_3P(O)$ (Aldrich 10,585-6); (6) triethoxy phosphine oxide $(C_2H_5O)_3P(O)$ (Aldrich T6,110-7); (7) tris (2-butoxyethyl)phosphate $[CH_3(CH_2)_3OCH_2CH_2O]_3P(O)$ (Aldrich 13059-1); and the like, as well as mixtures thereof.

Mixtures of any two or more of the above additive materials can also be employed.

The binder can be present within the coating in any effective amount; typically the binder and the additive material are present in relative amounts of from about 10 percent by weight binder and about 90 percent by weight additive material to about 99 percent by weight binder and about 1 percent by weight additive material, although the relative amounts can be outside of this range.

In addition, the coating of the recording sheets of the present invention can contain optional filler components. Fillers can be present in any effective amount provided that the substantial transparency of the recording sheet is maintained, and if present, typically are present in amounts of from about 0.5 to about 5.0 percent by weight of the coating composition. Examples of filler components include colloidal silicas, such as Syloid 74, available from Grace Company, titanium dioxide (available as Rutile or Anatase from NL Chem Canada, Inc.), hydrated alumina (Hydrad TMC-HBF, Hydrad TM-HBC, available from J.M. Huber Corporation), barium sulfate (K.C. Blanc Fix HD80, available from Kali Chemie Corporation), calcium carbonate (Microwhite Sylacauga Calcium Products), high brightness clays (such as Engelhard Paper Clays), calcium silicate (available from J.M. Huber Corporation), cellulosic materials insoluble in water or any organic solvents (such as those available from Scientific Polymer Products), blends of calcium fluoride and silica, such as Opalex-C available from Kemira.O.Y, zinc oxide, such as Zoco Fax 183, available from Zo Chem, blends of zinc sulfide with barium sulfate, such as Lithopane, available from Schteben Company, and the like, as well as mixtures thereof.

Further, the coating of the recording sheets of the present invention can contain optional antistatic components. Antistatic components can be present in any effective amount, and if present, typically are present in amounts of from about 0.5 to about 5.0 percent by weight of the coating composition. Examples of antistatic components include both anionic and cationic materials. Examples of anionic antistatic components include monoester sulfosuccinates, such as those of the general formula

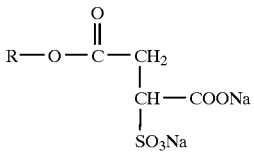

wherein R represents an alkanolamide or ethoxylated alcohol, diester sulfosuccinates, such as those of the general formula

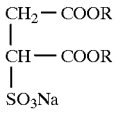

wherein R represents an alkyl group, and sulfosuccinamates, such as those of the general formula

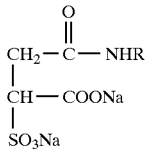

wherein R represents an alkyl group, all commercially available from Alkaril Chemicals as, for example, Alkasurf SS-L7DE, Alkasurf SS-L-HE, Alkasurf SS-OA-HE, Alkasurf SS-L9ME, Alkasurf SS-DA4-HE, Alkasurf SS-1B-45, Alkasurf SS-MA-80, Alkasurf SS-NO, Alkasurf SS-0-40, alkasurf SS-0-60PG, Alkasurf SS-0-70PG, Alkasurf SS-0-75, Alkasurf SS-TA, and the like. Examples of cationic antistatic components include diamino alkanes, such as those available from Aldrich Chemicals, quaternary salts, such as Cordex AT-172 and other materials available from Finetex Corp., and the like. Other suitable antistatic agents include quaternary acrylic copolymer latexes, particularly those of the formula

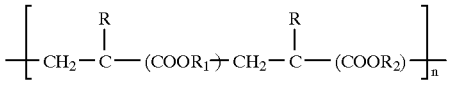

wherein n is a number of from about 10 to about 100, and preferably about 50, R is hydrogen or methyl, $R_1$ is hydrogen, an alkyl group, or an aryl group, and $R_2$ is $N^+(CH_3)_3X^-$, wherein X is an anion, such as Cl, Br, I, $HSO_3$, $SO_3$, $CH_2SO_3$, $H_2PO_4$, $HPO_4$, $PO_4$, or the like, and the degree of quaternization is from about 1 to about 100 percent, including polymers such as polymethyl acrylate trimethyl ammonium chloride latex, such as HX42-1, available from Interpolymer Corp., or the like.

Also suitable as antistatic agents are quaternary choline halides. Examples of suitable quaternary choline halides include (1) choline chloride [(2-hydroxyethyl) trimethyl ammonium chloride] $HOCH_2CH_2N(CH_3)_3Cl$ (Aldrich 23,994-1) and choline iodide $HOCH_2CH_2N(CH_3)_3I$ (Aldrich C7,971-9); (2) acetyl choline chloride $CH_3COOCH_2CH_2N(CH_3)_3Cl$ (Aldrich 13,535-6), acetyl choline bromide $CH_3COOCH_2CH_2N(CH_3)_3Br$ (Aldrich 85,968-0), and acetyl choline iodide $CH_3COOCH_2CH_2N(CH_3)_3I$ (Aldrich 10,043-9); (3) acetyl-β-methyl choline chloride $CH_3COOCH(CH_3)CH_2N(CH_3)Cl$ (Aldrich A1,800-1) and acetyl-β-methyl choline bromide $CH_3COOCH(CH_3)CH_2N(CH_3)_3Br$ (Aldrich 85,554-5); (4) benzoyl choline chloride $C_6H_5COOCH_2CH_2N(CH_3)_3Cl$ (Aldrich 21,697-6); (5) carbamyl choline chloride $H_2NCOOCH_2CH_2N(CH_3)_3Cl$ (Aldrich C240-9); (6) D,L-carnitinamide hydrochloride $H_2NCOCH_2CH(OH)CH_2N(CH_3)_3Cl$ (Aldrich 24,783-9); (7) D,L-carnitine hydrochloride $HOOCCH_2CH(OH)CH_2N(CH_3)_3Cl$ (Aldrich C1,600-8); (8) (2-bromo ethyl) trimethyl ammonium chloride [bromo choline chloride] $BrCH_2CH_2N(CH_3)_3Br$ (Aldrich 11,719-6); (9) (2-chloro ethyl) trimethyl ammonium chloride [chloro choline chloride) $ClCH_2CH_2N(CH_3)_3Cl$ (Aldrich 23,443-5); (10) (3-carboxy propyl) trimethyl ammonium chloride $HOOC(CH_2)_3N(CH_3)_3Cl$ (Aldrich 26,365-6); (11) butyryl choline chloride $CH_3CH_2CH_2COOCH_2CH_2N(CH_3)_3Cl$ (Aldrich 85,537-5); (12) butyryl thiocholine iodide $CH_3CH_2CH_2COSCH_2CH_2N(CH_3)_3I$ (Aldrich B10,425-6); (13) S-propionyl thiocholine iodide $C_2H_5COSCH_2CH_2N(CH_3)I$ (Aldrich 10,412-4); (14) S-acetylthiocholine bromide $CH_3COSCH_2CH_2N(CH_3)_3Br$ (Aldrich 85,533-2) and S-acetylthiocholine iodide $CH_3COSCH_2CH_2N(CH_3)_3I$ (Aldrich A2,230-0); (15) suberyl dicholine dichloride $[—(CH_2)_3COOCH_2CH_2N(CH_3)_3Cl]_2$ (Aldrich 86,204-5) and suberyl dicholine diiodide $[—(CH_2)_3COOCH_2CH_2N(CH_3)_3I]_2$ (Aldrich 86,211-8); and the like, as well mixtures thereof.

Additional examples of materials suitable as antistatic components include those disclosed in copending application Ser. Nos. 08/034,917, 08/034,943, 08/033,917, 08/034,445, and 08/033,918, the disclosures of each of which are totally incorporated herein by reference.

The antistatic agent can be present in any effective amount; typically, the antistatic agent is present in an amount of from about 1 to about 5 percent by weight of the coating, and preferably in an amount of from about 1 to about 2 percent by weight of the coating, although the amount can be outside these ranges.

Further, the coating of the recording sheets of the present invention can contain one or more optional biocides. Examples of suitable biocides include (A) non-ionic biocides, such as (1) 2-hydroxypropylmethane thiosulfonate (Busan 1005, available from Buckman Laboratories Inc.); (2) 2-(thio cyanomethyl thio) benzothiazole (Busan 30WB, 72WB, available from Buckman Laboratories Inc.); (3) methylene bis (thiocyanate) (Metasol T-10, available from Calgon Corporation; AMA-110, available from Vinings Chemical Company; Vichem MBT, available from Vineland Chemical Company; Aldrich 10,509-0); (4) 2-bromo-4'-hydroxyacetophenone (Busan 90, available from Buckman Laboratories); (5) 1,2-dibromo-2,4-dicyanobutane (Metasol CB-210, CB-235, available from Calgon Corporation); (6) 2,2-dibromo-3-nitropropionamide (Metasol RB-20, available from Calgon Corporation; Amerstat 300, available from Drew Industrial Div.); (7) N-α-(1-nitroethyl benzylethylene diamine) (Metasol J-26, available from Calgon Corporation); (8) dichlorophene (G-4, available from Givaudan Corporation); (9) 3,5-dimethyl tetrahydro-2H-1, 3,5-thiadiazine-2-thione (SLIME-TROL RX-28, available from Betz Paper Chem Inc.; Metasol D3T-A, available from Calgon Corporation; SLIME ARREST, available from Western Chemical Company); (10) a non-ionic blend of a sulfone, such as bis (trichloromethyl) sulfone and methylene bisthiocyanate (available as SLIME-TROL RX-38A from Betz Paper Chem Inc.); (11) a non-ionic blend of methylene bisthiocyanate and bromonitrostyrene (available as SLIME-TROL RX-41 from Betz Paper Chem Inc.); (12) a non-ionic blend of 2-(thiocyanomethylthio) benzothiazole (53.2% by weight) and 2-hydroxypropyl methanethiosulfonate (46.8% by weight) (available as BUSAN 25 from Buckman Laboratories Inc.); (13) a non-ionic blend of methylene bis (thiocyanate) 50 percent by weight and 2-(thiocyanomethylthio) benzothiazole 50 percent by weight (available as BUSAN 1009, 1009WB from Buckman Laboratories Inc.); (14) a non-ionic blend of 2-bromo-4'-hydroxyacetophenone (70 percent by weight) and 2-(thiocyanomethylthio) benzothiazole (30 percent by weight) (BUSAN 93, available from Buckman Laboratories Inc.); (15) a non-ionic blend of 5-chloro-2-methyl-4-isothiazoline-3-one (75 percent by weight) and 2-methyl-4-isothiazolin-3-one (25 percent by weight), (available as AMERSTAT 250 from Drew Industrial Division; NALCON 7647, from NALCO Chemical Company; Kathon LY, from Rohm and Haas Co.); and the like, as well as mixtures thereof; (B) anionic biocides, such as (1) anionic potassium N-hydroxymethyl-N-methyl-dithiocarbamate (available as BUSAN 40 from Buckman Larboratories Inc.); (2) an anionic blend of N-hydroxymethyl-N-methyl dithiocarbamate (80% by weight) and sodium 2-mercapto benzothiazole (20% by weight) (available as BUSAN 52 from Buckman Laboratories Inc.); (3) an anionic blend of sodium dimethyl dithiocarbamate 50 percent by weight and (disodium ethylenebis-dithiocarbamate) 50% by weight (available as METASOL 300 from Calgon Corporation; AMERSTAT 272 from Drew Industrial Division; SLIME CONTROL F from Western Chemical Company); (4) an anionic blend of N-methyidithiocarbamate 60 percent by weight and disodium cyanodithioimidocarbonate 40 percent by weight (available as BUSAN 881 from Buckman Laboratories Inc); (5) An anionic blend of methylene bis-thiocyanate (33% by weight), sodium dimethyl-dithiocarbamate (33% by weight), and sodium ethylene bisdithiocarbamate (33% by weight) (available as AMERSTAT 282 from Drew Industrial Division; AMA-131 from Vinings Chemical Company); (6) sodium dichlorophene (G-4-40, available from Givaudan Corp.); and the like, as well as mixtures thereof; (C) cationic biocides, such as (1) cationic poly (oxyethylene (dimethylamino)-ethylene (dimethylamino) ethylene dichloride) (Busan 77, available from Buckman Laboratories Inc.); (2) a cationic blend of methylene bisthiocyanate and dodecyl guanidine hydrochloride (available as SLIME TROL RX-31, RX-32, RX-32P, RX-33, from Betz Paper Chem Inc.); (3) a cationic blend of a sulfone, such as bis(trichloromethyl) sulfone and a quaternary ammonium chloride (available as SLIME TROL RX-36 DPB-865 from Betz Paper Chem. Inc.); (4) a cationic blend of methylene bis thiocyanate and chlorinated phenols (available as SLIME-TROL RX-40 from Betz Paper Chem Inc.); and the like, as well as mixtures thereof. The biocide can be present in any effective amount; typically, the biocide is present in an amount of from about 10 parts per million to about 3 percent by weight of the coating, although the amount can be outside this range.

The coating composition of the present invention can be applied to the substrate by any suitable technique. For example, the layer coatings can be applied by a number of known techniques, including melt extrusion, reverse roll coating, solvent extrusion, and dip coating processes. In dip coating, a web of material to be coated is transported below the surface of the coating material (which generally is dissolved in a solvent) by a single roll in such a manner that the exposed site is saturated, followed by the removal of any excess coating by a blade, bar, or squeeze roll; the process is then repeated with the appropriate coating materials for application of the other layered coatings. With reverse roll coating, the premetered coating material (which generally is dissolved in a solvent) is transferred from a steel applicator roll onto the web material to be coated. The metering roll is stationary or is rotating slowly in the direction opposite to that of the applicator roll. In slot extrusion coating, a flat die is used to apply coating material (which generally is dissolved in a solvent) with the die lips in close proximity to the web of material to be coated. Once the desired amount of coating has been applied to the web, the coating is dried, typically at from about 25 to about 100° C. in an air drier.

Recording sheets of the present invention can be employed in printing and copying processes wherein dry or liquid electrophotographic-type developers are employed, such as electrophotographic processes, ionographic processes, or the like. Yet another embodiment of the present invention is directed to a process for generating images which comprises generating an electrostatic latent image on an imaging member in an imaging apparatus; developing the latent image with a toner; transferring the developed image to a recording sheet of the present invention; and optionally permanently affixing the transferred image to the recording sheet. Still another embodiment of the present invention is directed to an imaging process which comprises generating an electrostatic latent image on a recording sheet of the present invention; developing the latent image with a toner; and optionally permanently affixing the developed image to the recording sheet. Electrophotographic processes are well known, as described in, for example, U.S. Pat. No. 2,297,691 to Chester Carlson. Ionographic and electrographic processes are also well known, and are described in, for example, U.S. Pat. No. 3,564,556, U.S. Pat. No. 3,611,419, U.S. Pat. No. 4,240,084, U.S. Pat. No. 4,569,584, U.S. Pat. No. 2,919,171, U.S. Pat. No. 4,524,371, U.S. Pat. No. 4,619,515, U.S. Pat. No. 4,463,363, U.S. Pat. No. 4,254,424, U.S. Pat. No. 4,538,163, U.S. Pat. No. 4,409,604, U.S. Pat. No. 4,408,214, U.S. Pat. No. 4,365,549, U.S. Pat. No. 4,267,556, U.S. Pat. No. 4,160,257, and U.S. Pat. No. 4,155,093, the disclosures of each of which are totally incorporated herein by reference.

In a particularly preferred embodiment, the present invention is directed to a process for generating images which comprises (1) generating an electrostatic latent image on an imaging member in an imaging apparatus; (2) developing the latent image with a toner which comprises a colorant and a resin selected from the group consisting of (A) polyesters; (B) polyvinyl acetals; (C) vinyl alcohol-vinyl acetal copolymers; (D) polycarbonates; and (E) mixtures thereof; and (3) transferring the developed image to a recording sheet of the present invention. Optionally, the transferred image may be permanently affixed to the recording sheet. It is preferred that the toner resin be a polymer containing the same monomers as the binder polymer of the recording sheet.

Examples of suitable toner resins for the process of the present invention include polyesters, such as polyester latexes, including as AQ-29D, available from Eastman Chemicals, poly(4,4-dipropoxy-2,2-diphenyl propane fumarate) #324, available from Scientific Polymer Products, poly(ethylene terephthalate) #138 and #418, available from Scientific Polymer Products, poly(ethylene succinate) #150, available from Scientific Polymer Products, poly(1,4-cyclohexane dimethylene succinate) #148, available from Scientific Polymer Products, or the like; polyvinyl acetate polymers, such as #346, #347, and #024, available from Scientific Polymer Products, or the like; vinylalcohol-vinyl acetate copolymers, such as those with a vinyl acetate content of about 91 percent by weight, including #379, available from Scientific Polymer Products, or the like; polycarbonates, such as #035, available from Scientific Polymer products, or the like; and the like, as well as mixtures thereof. In a preferred embodiment, the toner resin contains the same monomers present in the polymeric binder of the recording sheet. The resin is present in the toner in any effective amount, typically from about 10 to 95 percent by weight, preferably from about 20 to about 90 percent by weight, and more preferably from about 50 to about 70 percent by weight, although the amount can be outside these ranges.

Optionally, if it is desired to generate images that are visible with the naked eye, the toner composition can also contain a colorant. Typically, the colorant material is a pigment, although dyes can also be employed. Examples of suitable pigments and dyes are disclosed in, for example, U.S. Pat. No. 4,788,123, U.S. Pat. No. 4,828,956, U.S. Pat. No. 4,894,308, U.S. Pat. No. 4,948,686, U.S. Pat. No. 4,963,455, and U.S. Pat. No. 4,965,158, the disclosures of each of which are totally incorporated herein by reference. Specific examples of suitable dyes and pigments include carbon black, nigrosine dye, aniline blue, magnetites, and mixtures thereof, with carbon black being the most common colorant. The pigment should be present in an amount sufficient to render the toner composition highly colored to permit the formation of a clearly visible image on a recording member. Typically, the pigment particles are present in amounts of from about 1 percent by weight to about 20 percent by weight based on the total weight of the toner composition, although the amount can be outside this range.

When the pigment particles are magnetites, which comprise a mixture of iron oxides ($Fe_3O_4$) such as those commercially available as Mapico Black, these pigments are present in the toner composition in any effective amount, typically from about 10 percent by weight to about 70 percent by weight, and preferably from about 20 percent by weight to about 50 percent by weight, although the amount can be outside these ranges.

Colored toner pigments are also suitable, including red, green, blue, brown, magenta, cyan, and yellow particles, as well as mixtures thereof, wherein the colored pigments are present in amounts that enable the desired color. Illustrative examples of suitable magenta pigments include 2,9-dimethyl-substituted quinacridone and anthraquinone dye, identified in the color index as Cl 60710, Cl Dispersed Red 15, a diazo dye identified in the color index as Cl 26050, Cl Solvent Red 19, and the like. Illustrative examples of suitable cyan pigments include copper tetra-4-(octadecyl sulfonamido) phthalocyanine, copper phthalocyanine pigment, listed in the color index as Cl 74160, Pigment Blue, and Anthradanthrene Blue, identified in the color index as Cl 69810, Special Blue X-2137, and the like. Illustrative examples of yellow pigments that may be selected include diarylide yellow 3,3-dichlorobenzidene acetoacetanilides, a monoazo pigment identified in the color index as Cl 12700, Cl Solvent Yellow 16, a nitrophenyl amine sulfonamide identified in the color index as Foron Yellow SE/GLN, Cl Dispersed Yellow 33, 2,5-dimethoxy-4-sulfonanilide phenylazo-4'-chloro-2,5-dimethoxy aceto-acetanilide, Permanent Yellow FGL, and the like. Other suitable toner colorants include Normandy Magenta RD-2400 (Paul Uhlich), Paliogen Violet 5100 (BASF), Paliogen Violet 5890 (BASF), Permanent Violet VT2645 (Paul Uhlich), Heliogen Green L8730 (BASF), Argyle Green XP-111-S (Paul Uhlich), Brilliant Green Toner GR 0991 (Paul Uhlich), Heliogen Blue L6900, L7020 (BASF), Heliogen Blue D6840, D7080 (BASF), Sudan Blue OS (BASF), PV Fast Blue B2G01 (American Hoechst), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991 K (BASF), Paliotol Yellow 1840 (BASF), Novoperm Yellow FG1 (Hoechst), Permanent Yellow YE 0305 (Paul Uhlich), Lumogen Yellow D0790 (BASF), Suco-Gelb L1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Tolidine Red (Aldrich), Scarlet for Thermoplast NSD PS PA (Ugine Kuhlmann of Canada), E. D. Toluidine Red (Aldrich), Lithol Rubine Toner (Paul Uhlich), Lithol Scarlet 4440 (BASF), Bon Red C (Dominion Color Co.), Royal Brilliant Red RD-8192 (Paul Uhlich), Oracet Pink RF (Ciba-Geigy), Paliogen Red 3871K (BASF), Paliogen Red 3340 (BASF), and Lithol Fast Scarlet L4300 (BASF). Color pigments are typically present in the toner an amount of from about 15 to about 20.5 percent by weight, although the amount can be outside this range.

The toner compositions of the present invention can also contain an optional charge control additive. Examples of suitable charge control agents are disclosed in U.S. Pat. No. 4,788,123, U.S. Pat. No. 4,828,956, U.S. Pat. No. 4,894,308, U.S. Pat. No. 4,948,686, U.S. Pat. No. 4,963,455, and U.S. Pat. No. 4,965,158, the disclosures of each of which are totally incorporated herein by reference. Specific examples of suitable charge control agents include alkyl pyridinium halides, such as cetyl pyridinium chloride, as disclosed in U.S. Pat. No. 4,298,672, the disclosure of which is totally incorporated herein by reference, cetyl pyridinium tetrafluoroborates, quaternary ammonium sulfate and sulfonate compounds, such as distearyl dimethyl ammonium methyl sulfate, as disclosed in U.S. Pat. No. 4,338,390, the disclosure of which is totally incorporated herein by reference, stearyl phenethyl dimethyl ammonium tosylates, as disclosed in U.S. Pat. No. 4,338,390, distearyl dimethyl ammonium methyl sulfate, as disclosed in U.S. Pat. No. 4,560,635, the disclosure of which is totally incorporated herein by reference, distearyl dimethyl ammonium bisulfate as disclosed in U.S. Pat. No. 4,937,157 and U.S. Pat. No. 4,560,635, the disclosures of each of which are totally incorporated herein by reference, stearyl dimethyl hydrogen ammonium tosylate, charge control agents as disclosed in U.S. Pat. No. 4,294,904, the disclosure of which is totally incorporated herein by reference, zinc 3,5-di-tert-butyl salicylate compounds, such as Bontron E-84, available from Orient Chemical Company of Japan, or zinc compounds as disclosed in U.S. Pat. No. 4,656,112, the disclosure of which is totally incorporated herein by reference, aluminum 3,5-di-tert-butyl salicylate compounds, such as Bontron E-88, available from Orient Chemical Company of Japan, or aluminum compounds as disclosed in U.S. Pat. No. 4,845,003, the disclosure of which is totally incorporated herein by reference, and the like, as well as mixtures thereof and/or any other charge control agent suitable for dry electrophotographic toners. Additional examples of suitable charge control additives are disclosed in U.S. Pat. No. 4,560,635 and U.S. Pat. No. 4,294,904, the disclosures of each of which are totally incorporated herein by reference. Charge control agents are present in any effective amount, typically from about 0.1 to about 4 percent by weight, and more preferably from about 0.5 to about 1 percent by weight, although the amount can be outside this range.

The toner compositions can be prepared by any suitable method. For example, the components of the dry toner particles can be mixed in a ball mill, to which steel beads for agitation are added in an amount of approximately five times the weight of the toner. The ball mill can be operated at about 120 feet per minute for about 30 minutes, after which time the steel beads are removed. Dry toner particles for two-component developers generally have an average particle size of from about 6 to about 20 microns.

Another method, known as spray drying, entails dissolving the appropriate polymer or resin in an organic solvent such as toluene or chloroform, or a suitable solvent mixture. The toner colorant is also added to the solvent. Vigorous agitation, such as that obtained by ball milling processes, assists in assuring good dispersion of the colorant. The solution is then pumped through an atomizing nozzle while using an inert gas, such as nitrogen, as the atomizing agent. The solvent evaporates during atomization, resulting in toner particles of a colored resin, which are then attrited and classified by particle size. Particle diameter of the resulting toner varies, depending on the size of the nozzle, and generally varies between about 0.1 and about 100 microns.

Another suitable process is known as the Banbury method, a batch process wherein the dry toner ingredients are pre-blended and added to a Banbury mixer and mixed, at which point melting of the materials occurs from the heat energy generated by the mixing process. The mixture is then dropped into heated rollers and forced through a nip, which results in further shear mixing to form a large thin sheet of the toner material. This material is then reduced to pellet form and further reduced in size by grinding or jetting, after which the particles are classified by size.

Another suitable toner preparation process, extrusion, is a continuous process that entails dry blending the toner ingredients, placing them into an extruder, melting and mixing the mixture, extruding the material, and reducing the extruded material to pellet form. The pellets are further reduced in size by grinding or jetting, and are then classified by particle size.

Other similar blending methods may also be used. Subsequent to size classification of the toner particles, any external additives are blended with the toner particles. If desired, the resulting toner composition is then mixed with carrier particles.

Any suitable external additives can also be utilized with the dry toner particles. The amounts of external additives are measured in terms of percentage by weight of the toner composition, but are not themselves included when calculating the percentage composition of the toner. For example, a toner composition containing a resin, a colorant, and an external additive can comprise 80 percent by weight resin and 20 percent by weight colorant; the amount of external additive present is reported in terms of its percent by weight of the combined resin and colorant. External additives can include any additives suitable for use in electrostatographic toners, including straight silica, colloidal silica (e.g. Aerosil R972®, available from Degussa, Inc.), ferric oxide, Unilin (a linear polymeric alcohol comprising a fully saturated hydrocarbon backbone with at least about 80 percent of the polymeric chains terminated at one chain end with a hydroxyl group, of the general formula $CH_3(CH_2)_nCH_2OH$, wherein n is a number from about 30 to about 300, and preferably from about 30 to about 50, available from Petrolite Chemical Company), polyethylene waxes, polypropylene waxes, polymethylmethacrylate, zinc stearate, chromium oxide, aluminum oxide, stearic acid, polyvinylidene fluoride (e.g. Kynar®, available from Pennwalt Chemicals Corporation), and the like. External additives can be present in any desired or effective amount.

Dry toners can be employed alone in single component development processes, or they can be employed in combination with carrier particles in two component development processes. Any suitable carrier particles can be employed with the toner particles. Typical carrier particles include granular zircon, steel, nickel, iron ferrites, and the like. Other typical carrier particles include nickel berry carriers as disclosed in U.S. Pat. No. 3,847,604, the entire disclosure of which is incorporated herein by reference. These carriers comprise nodular carrier beads of nickel characterized by surfaces of reoccurring recesses and protrusions that provide the particles with a relatively large external area. The diameters of the carrier particles can vary, but are generally from about 50 microns to about 1,000 microns, thus allowing the particles to possess sufficient density and inertia to avoid adherence to the electrostatic images during the development process.

Carrier particles can possess coated surfaces. Typical coating materials include polymers and terpolymers, including, for example, fluoropolymers such as polyvinylidene fluorides as disclosed in U.S. Pat. No. 3,526,533, U.S. Pat. No. 3,849,186, and U.S. Pat. No. 3,942,979, the disclosures of each of which are totally incorporated herein by reference. Coating of the carrier particles may be by any suitable process, such as powder coating, wherein a dry powder of the coating material is applied to the surface of the carrier particle and fused to the core by means of heat, solution coating, wherein the coating material is dissolved in a solvent and the resulting solution is applied to the carrier surface by tumbling, or fluid bed coating, in which the carrier particles are blown into the air by means of an air stream, and an atomized solution comprising the coating material and a solvent is sprayed onto the airborne carrier particles repeatedly until the desired coating weight is achieved. Carrier coatings may be of any desired thickness or coating weight. Typically, the carrier coating is present in an amount of from about 0.1 to about 1 percent by weight of the uncoated carrier particle, although the coating weight may be outside this range.

The toner is present in the two-component developer in any effective amount, typically from about 1 to about 5 percent by weight of the carrier, and preferably about 3 percent by weight of the carrier, although the amount can be outside these ranges.

Any suitable conventional electrophotographic development technique can be utilized to deposit toner particles of the present invention on an electrostatic latent image on an imaging member. Well known electrophotographic development techniques include magnetic brush development, cascade development, powder cloud development, electrophoretic development, and the like. Magnetic brush development is more fully described, for example, in U.S. Pat. No. 2,791,949, the disclosure of which is totally incorporated herein by reference; cascade development is more fully described, for example, in U.S. Pat. No. 2,618,551 and U.S. Pat. No. 2,618,552, the disclosures of each of which are totally incorporated herein by reference; powder cloud development is more fully described, for example, in U.S. Pat. No. 2,725,305, U.S. Pat. No. 2,918,910, and U.S. Pat. No. 3,015,305, the disclosures of each of which are totally incorporated herein by reference; and liquid development is more fully described, for example, in U.S. Pat. No. 3,084,043, the disclosure of which is totally incorporated herein by reference.

The deposited toner image can be transferred to the recording sheet by any suitable technique conventionally used in electrophotography, such as corona transfer, pressure transfer, adhesive transfer, bias roll transfer, and the like. Typical corona transfer entails contacting the deposited toner particles with a sheet of paper and applying an electrostatic charge on the side of the sheet opposite to the toner particles. A single wire corotron having applied thereto a potential of between about 5000 and about 8000 volts provides satisfactory electrostatic charge for transfer.

After transfer, the transferred toner image can be fixed to the recording sheet. The fixing step can be also identical to that conventionally used in electrophotographic imaging. Typical, well known electrophotographic fusing techniques include heated roll fusing, flash fusing, oven fusing, laminating, adhesive spray fixing, and the like.

The recording sheets of the present invention can also be used in any other printing or imaging process, such as printing with pen plotters, handwriting with ink pens, offset printing processes, or the like, provided that the ink employed to form the image is compatible with the ink receiving layer of the recording sheet.

Specific embodiments of the invention will now be described in detail. These examples are intended to be illustrative, and the invention is not limited to the materials, conditions, or process parameters set forth in these embodiments. All parts and percentages are by weight unless otherwise indicated.

EXAMPLE I

Transparency sheets were prepared by a dip coating process (both sides coated in one operation) by providing Mylar® sheets (8.5×11 inches) in a thickness of 100 microns and coating them with blends of a binder resin, an additive, an antistatic agent, and a traction agent. The coated Mylar® sheets were then dried in a vacuum hood for one hour. Measuring the difference in weight prior to and subsequent to coating these sheets indicated an average coating weight of about 300 milligrams on each side in a thickness of about 3 microns. These sheets were fed into a Xerox® 1038 copier and black images were obtained with optical densities of about 1.3. The images could not be lifted off with Scotch® tape (3M).

The recording sheet coating compositions were as follows:

1: Polyester latex (Eastman AQ 29D), 78 percent by weight; dimethyl suberate (Aldrich 14,901-2), 20 percent by weight; suberyl dicholine dichloride (Aldrich 86,204-5), 1 percent by weight; colloidal silica, Syloid 74, obtained from W.R. Grace & Co., 1 percent by weight. Solids present in water solution in a concentration of 25 percent by weight.

2: Polyester latex (Eastman AQ 29D), 78 percent by weight; 3,4-bis (acetoxy methyl) furan (Aldrich 14,409-6), 20 percent by weight; acetyl choline chloride (Aldrich 13,535-6), 1 percent by weight; colloidal silica, 1 percent by weight. Solids present in water solution in a concentration of 25 percent by weight.

3: Vinyl alcohol-vinyl acetate copolymer (vinyl acetate content 91 percent by weight (Scientific Polymer Products #379), 78 percent by weight; undecanoic γ-lactone (Aldrich U 80-6), 20 percent by weight; acetyl-β-methyl choline chloride, 1 percent by weight; colloidal silica, 1 percent by weight. Solids present in acetone solution in a concentration of 5 percent by weight.

4: Vinyl alcohol-vinyl acetate copolymer (vinyl acetate content 91 percent by weight) (Scientific Polymer Products #379), 88 percent by weight; propiophenone (Aldrich P5,160-5), 10 percent by weight; s-acetyl thiocholine bromide (Aldrich 85,333-2), 1 percent by weight; colloidal silica, 1 percent by weight. Solids present in acetone solution in a concentration of 5 percent by weight.

5: Poly carbonate (Scientific Polymer Products #035),78 percent by weight; cis-1,2-cyclohexane dicarboxylic anhydride (Aldrich 12,346-3), 20 percent by weight; D,L-carnitine hydrochloride (Aldrich C1,600-8), 1 percent by weight; colloidal silica, 1 percent by weight. Solids present in dichloromethane solution in a concentration of 5 percent by weight.

6: Polycarbonate (Scientific Polymer Products #035), 78 percent by weight; cyclopentadecanone (Aldrich C11,120-1), 20 percent by weight; benzoyl choline chloride (Aldrich 21,697-6), 1 percent by weight; colloidal silica, 1 percent by weight. Solids present in dichloromethane solution in a concentration of 5 percent by weight.

7: None (Untreated).

8: Polyester latex (Eastman AQ 29D), 100 percent by weight.
Solids present in water solution in a concentration 5 percent by weight.

9: Polyester latex (Eastman AQ 29D), 80 percent by weight; (±)-β,β-dimethyl-γ-(hydroxymethyl)-γ-butyrolactone (Aldrich 26,496-2), 18 percent by weight; D,L-carnitinamide hydrochloride (Aldrich 24,783-9), 2 percent by weight. Solids present in water solution in a concentration of 25 percent by weight.

10: Polyester latex (Eastman AQ 29D), 90 percent by weight; furfuryl acetate (Aldrich 16,620-0), 10 percent by weight. Solids present in water solution in a concentration of 25 percent by weight.

The optical densities of the images before and after the tape test were as follows:

| | | Optical Density | | |
|---|---|---|---|---|
| # | Substrate | Before | After | % TF |
| 1 | Mylar ® | 1.33 | 1.33 | 100 |
| 2 | Mylar ® | 1.25 | 1.20 | 96 |
| 3 | Mylar ® | 1.25 | 1.20 | 96 |
| 4 | Mylar ® | 1.25 | 1.15 | 92 |
| 5 | Mylar ® | 1.23 | 1.13 | 92 |
| 6 | Mylar ® | 1.26 | 1.20 | 92 |
| 7 | 4024 ® paper | 1.25 | 0.87 | 70 |
| 8 | 4024 ® paper | 1.25 | 1.15 | 92 |
| 9 | 4024 ® paper | 1.28 | 1.28 | 100 |
| 10 | 4024 ® paper | 1.30 | 1.30 | 100 |

As the results indicate, the transparent recording sheets coated with the blends of binder and additive exhibited toner fix of from 92 percent to 100 percent. The untreated paper sheet exhibited a toner fix of 70 percent, which improved to 92 percent when treated with a binder and further improved to 100 percent when treated with a blend of binder and additive.

Other embodiments and modifications of the present invention may occur to those skilled in the art subsequent to a review of the information presented herein; these embodiments and modifications, as well as equivalents thereof, are also included within the scope of this invention.

What is claimed is:

1. A recording sheet which comprises (a) a substrate; (b) a coating on the substrate which comprises (1) a binder selected from the group consisting of (A) polyesters; (B) polyvinyl acetals; (C) vinyl alcohol-vinyl acetal copolymers; (D) polycarbonates; and (E) mixtures thereof; and (2) a non-polymeric additive having a melting point of less than about 65° C. and a boiling point of more than about 150° C. and selected from the group consisting of (1) furan derivatives; (2) cyclic ketones; (3) (3) cyclic alcohols selected from the group consisting of 1,2-cycloheptane diol, cis-3,5-cyclohexadiene-1,2-diol, and mixtures thereof; (4) cyclic anhydrides; (5) acid esters selected from the group consisting of adipic acid monomethyl ester, adipic acid monoethyl ester, suberic acid monomethyl ester, azelaic acid monomethyl ester, and mixtures thereof; (6) phosphine oxides; and (7) mixtures thereof; (c) an optional filler; (d) an optional antistatic agent; and (e) an optional biocide.

2. A process for generating images which comprises (1) generating an electrostatic latent image on an imaging member in an imaging apparatus; (2) developing the latent image with a toner which comprises a colorant and a resin selected from the group consisting of (A) polyesters; (B) polyvinyl acetals; (C) vinyl alcohol-vinyl acetal copolymers; (D) polycarbonates; and (E) mixtures thereof; and (3) transferring the developed image to a recording sheet which comprises (a) a substrate; (b) a coating on the substrate which comprises (1) a binder selected from the group consisting of (A) polyesters; (B) polyvinyl acetals; (C) vinyl alcohol-vinyl acetal copolymers; (D) polycarbonates; and (E) mixtures thereof; and (2) an additive having a melting point of less than about 65° C. and a boiling point of more than about 150° C. and selected from the group consisting of (1) furan derivatives; (2) cyclic ketones; (3) non-polymeric lactones; (4) cyclic alcohols selected from the group consisting of 1,2-cycloheptane diol and cis-3,5-cyclohexadiene-1,2-diol; (5) cyclic anhydrides; (6) acid esters; (7) esters selected from the group consisting of (a) dialkyl esters; (b) oligomeric esters of the formula

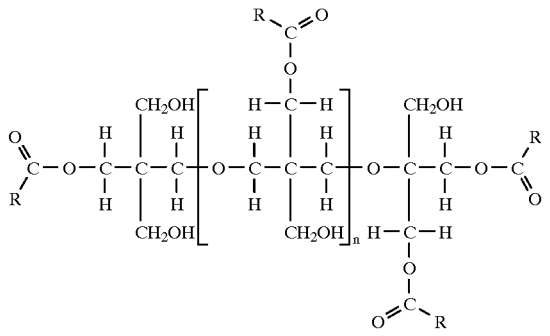

wherein the acyl groups are derived from a blend of lauric and myristic acids and n is an integer of from 1 to about 10; (c) methyl salicylate; (d) phenyl salicylate; (e) benzyl cinnamate; and (f) trans methyl cinnamate; (8) phenones of the formula

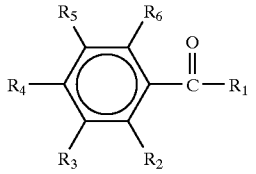

wherein $R_1$ is alkyl, substituted alkyl, aryl, substituted aryl, arylalkyl, or substituted arylalkyl, and $R_2$, $R_3$, $R_4$, $R_5$, and $R_6$ each, independently of the others, are hydrogen, alkyl, substituted alkyl, aryl, substituted aryl, arylalkyl, substituted arylalkyl, halogen, alkoxy, aryloxy, arylalkyloxy, or cyano; (9) phosphine oxides; and (10) mixtures thereof; (c) an optional filler; (d) an optional antistatic agent; and (e) an optional biocide.

3. A process according to claim 2 wherein the binder and the additive material are present in relative amounts of from about 10 percent by weight binder and about 90 percent by weight additive material to about 99 percent by weight binder and about 1 percent by weight additive material.

4. A process according to claim 2 wherein the additive is a cyclic ketone.

5. A process according to claim 2 wherein the additive is selected from the group consisting of (1) cyclohexanone; (2) cycloheptanone; (3) cyclooctanone; (4) cyclononanone; (5) cyclodecanone; (6) cycloundecanone; (7) cyclododecanone; (8) cyclotridecanone; (9) cyclopentadecanone; (10) 2-phenylcyclohexanone; (11) cyclohexane dione; (12) tropolone; (13) 1,4-cyclohexanedione mono-2,2-dimethyl trimethylene ketal; (14) 8-cyclohexadecen-1-one; and mixtures thereof.

6. A process according to claim 2 wherein the additive is a cyclic alcohol selected from the group consisting of 1,2-cycloheptane diol and cis-3,5-cyclohexadiene-1,2-diol.

7. A process according to claim 2 wherein the additive is a cyclic anhydride.

8. A process according to claim 2 wherein the additive is selected from the group consisting of (1) maleic anhydride; (2) bromo maleic anhydride; (3) methyl succinic anhydride; (4) citraconic anhydride; (5) 2,2-dimethyl succinic anhydride; (6) 2-dodecen-1-yl succinic anhydride; (7) glutaric anhydride; (8) 3-methyl glutaric anhydride; (9) 2,2-dimethyl glutaric anhydride; (10) 3,3-tetramethylene glutaric anhydride; (11) 1-cyclopentene-1,2-dicarboxylic anhydride; (12) cis-1,2-cyclohexane dicarboxylic anhydride; (13) 3-benzyl phthalide; (14) benzoic anhydride; (15) hexahydro-4-methyl phthalic anhydride; (16) methyl-5-norbornene-2,3-dicarboxylic anhydride; and mixtures thereof.

9. A process according to claim 2 wherein the additive is an acid ester.

10. A process according to claim 2 wherein the additive is selected from the group consisting of (1) tripiperidinophosphine oxide; (2) triphenyl phosphine oxide; (3) tris (hydroxymethyl) phosphine oxide; (4) trimethoxy phosphine oxide; (5) triphenoxy phosphine oxide; (6) triethoxy phosphine oxide; (7) tris (2-butoxyethyl) phosphate; and mixtures thereof.

11. A process according to claim 2 wherein the binder is a polyester.

12. A process according to claim 2 wherein the binder is a polyvinyl acetal.

13. A process according to claim 2 wherein the binder is a vinyl alcohol-vinyl acetal copolymer.

14. A process according to claim 2 wherein the binder is a polycarbonate.

15. A process according to claim 2 wherein the binder is selected from the group consisting of polyester latexes, poly(4,4-dipropoxy-2,2-diphenyl propane fumarate), poly (ethylene terephthalate), poly(ethylene succinate), poly(1,4-cyclohexane dimethylene succinate), and mixtures thereof.

16. A process according to claim 2 wherein the toner resin contains the same monomers contained in the binder on the recording sheet.

17. A process according to claim 2 wherein the coating contains an antistatic agent which is selected from the group consisting of (1) choline halides; (2) acetyl choline halides; (3) acetyl-β-methyl choline halides; (4) benzoyl choline halides; (5) carbamyl choline halides; (6) carnitinamide hydrohalides; (7) carnitine hydrohalides; (8) (2-bromo ethyl) trimethyl ammonium halides; (9) (2-chloro ethyl) trimethyl ammonium halides; (10) (3-carboxy propyl) trimethyl ammonium halides; (11) butyryl choline halides; (12) butyryl thiocholine halides; (13) S-propionyl thiocholine halides; (14) S-acetylthiocholine halides; (15) suberyl dicholine dihalides; and mixtures thereof.

18. A process according to claim 2 wherein the coating contains an antistatic agent.

19. A process according to claim 2 wherein the coating contains a biocide.

20. A process according to claim 2 wherein the substrate is paper.

21. A process for generating images which comprises (1) generating an electrostatic latent image on an imaging member in an imaging apparatus; (2) developing the latent image with a toner which comprises a colorant and a resin selected from the group consisting of (A) polyesters; (B) polyvinyl acetals; (C) vinyl alcohol-vinyl acetal copolymers; (D) polycarbonates; and (E) mixtures thereof; and (3) transferring the developed image to a recording sheet which comprises (a) a substrate; (b) a coating on the substrate which comprises (1) a binder selected from the group consisting of (A) polyesters; (B) polyvinyl acetals; (C) vinyl alcohol-vinyl acetal copolymers; (D) polycarbonates; and (E) mixtures thereof; and (2) an additive having a melting point of less than about 65° C. and a boiling point of more than about 150° C. and selected from the group consisting of (1) furan derivatives; (2) cyclic ketones; (3) lactones; (4) cyclic alcohols; (5) cyclic anhydrides; (6) acid esters; (7) esters; (8) phenones; (9) phosphine oxides; and (10) mixtures thereof; (c) an optional filler; (d) an antistatic agent which is a quaternary acrylic copolymer latex; and (e) an optional biocide.

22. A process for generating images which comprises (1) generating an electrostatic latent image on an imaging member in an imaging apparatus; (2) developing the latent image with a toner which comprises a colorant and a resin selected from the group consisting of (A) polyesters; (B) polyvinyl acetals; (C) vinyl alcohol-vinyl acetal copolymers; (D) polycarbonates; and (E) mixtures thereof; and (3) transferring the developed image to a recording sheet which comprises (a) a substrate; (b) a coating on the substrate which comprises (1) a binder selected from the group consisting of (A) polyesters; (B) polyvinyl acetals; (C) vinyl alcohol-vinyl acetal copolymers; (D) Polycarbonates; and (E) mixtures thereof; and (2) an additive having a melting point of less than about 65° C. and a boiling point of more than about 150° C. and selected from the group consisting of furan derivatives and mixtures thereof; (c) an optional filler; (d) an optional antistatic agent; and (e) an optional biocide.

23. A process according to claim 22 wherein the additive is selected from the group consisting of (1) methyl 2-furoate; (2) ethyl 2-furoate; (3) 2-furaldehyde diethylacetal; (4) furfuryl acetate; (5) 2,5-dimethoxy-2,5-dihydrofuran; (6) methyl 2,5-dihydro-2,5-dimethoxy-2-furan carboxylate; (7) 5-methylfurfural; (8) 5-(hydroxymethyl) furfural; (9) 5-acetoxymethyl-2-furaldehyde; (10) 2-acetyl-5-methyl furan; (11) dimethyl 3,4-furanedicarboxylate; (12) diethyl 3,4-furandicarboxylate; (13) 3,4-bis (acetoxymethyl) furan; (14) 3-acetyl-2,5dimethyl furan; (15) ethyl β-oxo-3-furanpropionate; (16) 2,3-dihydrobenzofuran; (17) 2-methylbenzofuran; (18) 2-methoxydibenzofuran; (19) 3-hydroxy tetrahydrofuran; (20) 2-ethyoxytetrahydrofuran; (21) tetrahydrofurfuryl alcohol; (22) tetrahydrofurfuryl amine; (23) tetrahydrofurfuryl chloride; (24) 2,3-diethoxytetrahydrofuran; and mixtures thereof.

24. A process for generating images which comprises (1) generating an electrostatic latent image on an imaging member in an imaging apparatus; (2) developing the latent image with a toner which comprises a colorant and a resin selected from the group consisting of (A) polyesters; (B) polyvinyl acetals; (C) vinyl alcohol-vinyl acetal copolymers; (D) polycarbonates; and (E) mixtures thereof; and (3) transferring the developed image to a recording sheet which comprises (a) a substrate; (b) a coating on the substrate which comprises (1) a binder selected from the group consisting of (A) polyesters; (B) polyvinyl acetals; (C) vinyl alcohol-vinyl acetal copolymers; (D) polycarbonates; and (E) mixtures thereof; and (2) an additive having a melting point of less than about 65° C. and a boiling point of more than about 150° C. and selected from the group consisting of (a) dialkyl esters; (b) oligomeric esters of the formula

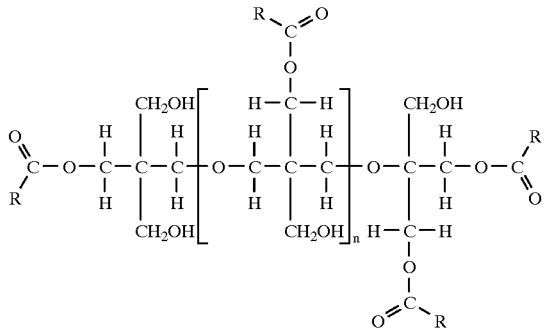

wherein the acyl groups are derived from a blend of lauric and myristic acids and n is an integer of from 1 to about 10; (c) methyl salicylate; (d) phenyl salicylate; (e) benzyl cinnamate; and (f) trans methyl cinnamate.

25. A process for generating images which comprises (1) generating an electrostatic latent image on an imaging member in an imaging apparatus; (2) developing the latent image with a toner which comprises a colorant and a resin selected from the group consisting of (A) polyesters; (B) polyvinyl acetals; (C) vinyl alcohol-vinyl acetal copolymers; (D) polycarbonates; and (E) mixtures thereof; and (3) transferring the developed image to a recording sheet which comprises (a) a substrate; (b) a coating on the substrate which comprises (1) a binder selected from the group consisting of (A) polyesters; (B) polyvinyl acetals; (C) vinyl alcohol-vinyl acetal copolymers; (D) polycarbonates; and (E) mixtures thereof; and (2) an additive having a melting point of less than about 65° C. and a boiling point of more than about 150° C. and selected from the group consisting of (1) dimethyl oxalate; (2) dimethyl malonate; (3) dimethyl succinate; (4) dimethyl glutarate; (5) dimethyl adipate; (6) dimethyl pimelate; (7) dimethyl suberate; (8) dimethyl azelate; (9) dimethyl sebacate; (10) dimethyl brassylate; (11) dimethyl tartrate; (12) dimethyl methyl malonate; (13) dimethyl methoxy malonate; (14) dimethyl methyl succinate; (15) dimethyl itaconate; (16) dimethyl maleate; (17) diethyloxalate; (18) diethylmalonate; (19) diethyl succinate; (20) diethyl glutarate; (21) diethyl adipate; (22) diethyl pimelate; (23) diethyl suberate; (24) diethyl azelate; (25) diethyl sebacate; (26) diethyl dodecanedioate; (27) diethyl tetradecanedioate; (28) diethyl methyl malonate; (29) diethyl propyl malonate; (30) diethyl butyl malonate; (31) diethyl benzyl malonate; (32) diethyl phenyl malonate; (33) diethyl keto malonate; (34) diethyl maleate; (35) diethyl fumarate; (36) diethyl glutaconate; (37) diethyl tartrate; (38) diethyl dimethyl malonate; (39) diethyl diethyl malonate; (40) diethyl (bishydroxymethyl) malonate; (41) oligomeric esters of the formula

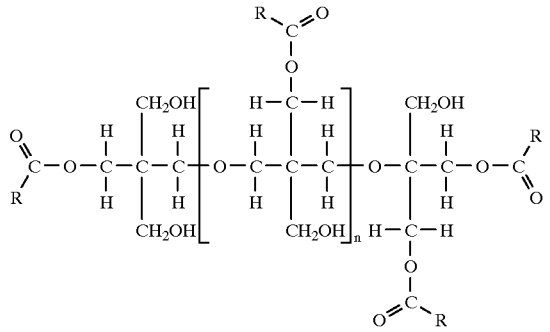

wherein the acyl groups are derived from a blend of lauric and myristic acids and n is an integer of from 1 to about 10; (42) methyl salicylate; (43) phenyl salicylate; (44) benzyl cinnamate; (45) trans methyl cinnamate; and mixtures thereof.

26. A process for generating images which comprises (1) generating an electrostatic latent image on an imaging member in an imaging apparatus; (2) developing the latent image with a toner which comprises a colorant and a resin selected from the group consisting of (A) polyesters; (B) polyvinyl acetals; (C) vinyl alcohol-vinyl acetal copolymers; (D) polycarbonates; and (E) mixtures thereof; and (3) transferring the developed image to a recording sheet which comprises (a) a substrate; (b) a coating on the substrate which comprises (1) a binder selected from the group consisting of (A) polyesters; (B) polyvinyl acetals; (C) vinyl alcohol-vinyl acetal copolymers; (D) polycarbonates; and (E) mixtures thereof; and (2) an additive having a melting point of less than about 65° C. and a boiling point of more than about 150° C., wherein the additive is a phenone of the formula

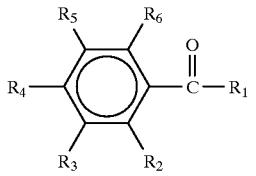

wherein $R_1$ is alkyl, substituted alkyl, aryl, substituted aryl, arylalkyl, or substituted arylalkyl, and $R_2$, $R_3$, $R_4$, $R_5$, and $R_6$ each, independently of the others, are hydrogen, alkyl, substituted alkyl, aryl, substituted aryl, arylalkyl, substituted arylalkyl, halogen, alkoxy, aryloxy, arylalkyloxy, or cyano.

27. A process for generating images which comprises (1) generating an electrostatic latent image on an imaging member in an imaging apparatus; (2) developing the latent image with a toner which comprises a colorant and a resin selected from the group consisting of (A) polyesters; (B) polyvinyl acetals; (C) vinyl alcohol-vinyl acetal copolymers; (D) polycarbonates; and (E) mixtures thereof; and (3) transferring the developed image to a recording sheet which comprises (a) a substrate; (b) a coating on the substrate which comprises (1) a binder selected from the group consisting of (A) polyesters; (B) polyvinyl acetals; (C) vinyl alcohol-vinyl acetal copolymers; (D) polycarbonates; and (E) mixtures thereof; and (2) an additive having a melting point of less than about 65° C. and a boiling point of more than about 150° C., wherein the additive is selected from the group consisting of (1) acetophenone; (2) 2-chloroacetophenone; (3) 2-bromo acetophenone; (4) 2'-bromoacetophenone; (5) 3'-bromoacetophenone; (6) 4'-bromo acetophenone; (7) 2'-choloro acetophenone; (8) 3'-chloroacetophenone; (9) 4'-chloroacetophenone; (10) 2-methoxyacetophenone; (11) 2'-methoxy acetophenone; (12) 3'-methoxyacetophenone; (13) 4'-methoxyacetophenone; (14) 4'-ethoxyacetophenone; (15) 4'-cyanoacetophenone; (16) 2',4'-dimethoxy acetophenone; (17) 3',4'-dimethoxy acetophenone; (18) 3',5'-dimethoxy acetophenone; (19) 2',4',6'-trimethyl acetophenone; (20) 2',3',4'-trimethoxy acetophenone; (21) 4'-cyclohexyl acetophenone; (22) 4'-phenoxy acetophenone; (23) 2-bromo-2'-methoxy acetophenone; (24) 2-bromo-3'-methoxy acetophenone; (25) 2-bromo-4'-methoxy acetophenone; (26) 2',3',4'-trichloroacetophenone; (27) 2,2',4'-trichloroacetophenone; (28) 2',4'-dimethoxy-3'-methyl acetophenone; (29) benzophenone; (30) 4-methoxy benzophenone; (31) 2-chlorobenzophenone; (32) 2,5-dimethyl benzophenone; (33) 3,4-dimethyl benzophenone; (34) butyrophenone; (35) isobutyrophenone; and mixtures thereof; (c) an optional filler; (d) an optional antistatic agent; and (e) an optional biocide.

28. A process for generating images which comprises (1) generating an electrostatic latent image on an imaging member in an imaging apparatus; (2) developing the latent image with a toner which comprises a colorant and a resin selected from the group consisting of (A) polyesters; (B) polyvinyl acetals; (C) vinyl alcohol-vinyl acetal copolymers; (D) polycarbonates; and (E) mixtures thereof; and (3) transferring the developed image to a recording sheet which comprises (a) a substrate; (b) a coating on the substrate which comprises (1) a binder selected from the group consisting of (A) polyesters; (B) polyvinyl acetals; (C) vinyl alcohol-vinyl acetal copolymers; (D) polycarbonates; and (E) mixtures thereof; and (2) an additive having a melting point of less than about 65° C. and a boiling point of more than about 150° C., wherein the additive is a phosphine oxide.

29. A process for generating images which comprises (1) generating an electrostatic latent image on an imaging member in an imaging apparatus; (2) developing the latent image with a toner which comprises a colorant and a resin selected from the group consisting of (A) polyesters; (B) polyvinyl acetals; (C) vinyl alcohol-vinyl acetal copolymers; (D) polycarbonates; and (E) mixtures thereof; and (3) transferring the developed image to a recording sheet which consists essentially of (a) a substrate; (b) a coating on the substrate which consists essentially of (1) a binder selected from the group consisting of (A) polyesters; (B) polyvinyl acetals; (C) vinyl alcohol-vinyl acetal copolymers; (D) polycarbonates; and (E) mixtures thereof; and (2) an additive having a melting point of less than about 65° C. and a boiling point of more than about 150° C. and selected from the group consisting of (A) furan derivatives; (B) cyclic ketones; (C) cyclic alcohols selected from the group consisting of 1,2-cycloheptane diol and cis-3,5-cyclohexadiene-1,2-diol; (D) cyclic anhydrides; (E) acid esters; (F) phosphine oxides; and (G) mixtures thereof; (c) an optional filler; (d) an optional antistatic agent; and (e) an optional biocide.

* * * * *